US005135447A

United States Patent [19]

Robards, Jr. et al.

[11] Patent Number: 5,135,447

[45] Date of Patent: Aug. 4, 1992

[54] EXERCISE APPARATUS FOR SIMULATING STAIR CLIMBING

[75] Inventors: Chester F. Robards, Jr., Roselle; Steven J. Cinke, Crete; Stephen A. Waltasti, Wheaton; Robert Kohan, Naperville, all of Ill.; Donald J. Alexander, Milwaukee, Wis.; Douglas G. Guenther, Carol Stream, Ill.; David J. Thum, Roselle, Ill.; Tomas Leon, Chicago, Ill.

[73] Assignee: Life Fitness, Franklin Park, Ill.

[21] Appl. No.: 669,815

[22] Filed: Mar. 15, 1991

Related U.S. Application Data

[63] Continuation-in-part of Ser. No. 426,909, Oct. 29, 1989, abandoned, which is a continuation-in-part of Ser. No. 260,968, Oct. 21, 1988, abandoned.

[51] Int. Cl.[5] ..... A63B 23/04

[52] U.S. Cl. ..... 482/52; 482/6; 482/7; 482/8

[58] Field of Search ..... 272/69, 70, 72, 73, 272/129, 130, DIG. 5, DIG. 6, 134; 128/25 R; 73/379; 474/91

[56] References Cited

U.S. PATENT DOCUMENTS

| | | | |
|---|---|---|---|
| D. 263,490 | 3/1982 | Hickman . | |
| 2,079,594 | 5/1937 | Clem . | |
| 2,826,192 | 3/1958 | Mangras . | |
| 3,316,898 | 5/1967 | Brown . | |
| 3,497,215 | 2/1970 | Harrison et al. . | |
| 3,511,500 | 5/1970 | Dunn | 272/70 X |
| 3,529,474 | 9/1970 | Olson et al. . | |
| 3,592,466 | 7/1971 | Parsods . | |
| 3,628,791 | 12/1971 | Garcia . | |
| 3,638,645 | 2/1972 | Kitada . | |
| 3,701,529 | 10/1972 | Krothaopt . | |
| 3,747,924 | 7/1973 | Champoux | 272/70 |
| 3,792,860 | 2/1974 | Seldes | 272/70 X |
| 3,842,684 | 10/1974 | Lozier | 474/91 X |
| 3,917,262 | 11/1975 | Salkeld | 272/118 |
| 3,970,302 | 7/1976 | McFee | 272/130 |
| 4,346,886 | 8/1982 | Cox et al. | 272/70 X |
| 4,358,105 | 11/1982 | Sweedet, Jr. | 272/73 |
| 4,408,183 | 10/1983 | Wills | 272/DIG. 5 X |
| 4,493,485 | 1/1985 | Jodes | 73/379 X |
| 4,496,147 | 1/1985 | DeCloox et al. | 272/70 X |
| 4,555,108 | 11/1985 | Monteiro | 272/69 |
| 4,587,960 | 5/1986 | Schotten | 128/25 R |
| 4,600,187 | 7/1986 | Schenkler | 272/70 |
| 4,645,200 | 2/1987 | Hix | 272/70 X |
| 4,676,501 | 6/1987 | Hoagland et al. | 272/70 |
| 4,687,195 | 8/1987 | Potts | 272/70 X |
| 4,705,271 | 11/1987 | Mondlock et al. | 272/130 |
| 4,708,338 | 11/1987 | Potts | 272/70 |
| 4,720,093 | 1/1988 | Del Mar | 272/70 |
| 4,781,658 | 11/1988 | Takano et al. | 474/91 |
| 4,809,973 | 3/1989 | Johns | 272/117 X |
| 4,830,362 | 5/1989 | Bull | 272/130 |
| 4,850,585 | 7/1989 | Daleboot | 272/70 |
| 4,878,663 | 11/1989 | Loquette | 272/117 X |
| 4,881,928 | 11/1989 | Bernal | 474/91 X |
| 4,940,233 | 7/1990 | Bull et al. | 272/70 X |

FOREIGN PATENT DOCUMENTS

| | | | |
|---|---|---|---|
| 523174 | 4/1931 | Fed. Rep. of Germany | 272/70 |

*Primary Examiner*—Robert Bahr
*Attorney, Agent, or Firm*—Jenner & Block

[57] ABSTRACT

A step type exercise apparatus is disclosed in which two pedal members are connected for reciprocating movement by a chain which, in turn, operates through a transmission providing a resistive force to the pedals. The resistive force is supplied by an alternator which is controlled by a computer. Means are provided to lubricate the chain thereby prolonging the life of the chain.

180 Claims, 10 Drawing Sheets

EXERCISE APPARATUS FOR SIMULATING STAIR CLIMBING

RELATED APPLICATIONS

This application is a continuation-in-part of U.S. patent application Ser. No. 07/426,909, filed on Oct. 29, 1989, now abandoned, which is a continuation-in-part of U.S. patent application Ser. No. 07/260,968, filed on Oct. 21, 1988, now abandoned.

TECHNICAL FIELD

The invention relates to the field of stair climbing apparatus and in particular to a stair climbing apparatus where the rate of stair climbing is controlled by an alternator.

BACKGROUND OF THE INVENTION

Stair climbing has become recognized as a particularly effective type of aerobic exercise and as a result, exercise machines facilitating this type of exercise are becoming increasingly popular for both home and health club use.

There have been a variety of approaches taken in designing stair climbing apparatus including the simulation of an actual stair case as illustrated in U.S. Pat. Nos. 3,497,215 and 4,687,195. Another popular approach has been to simulate he action of stair climbing by using a pair of reciprocating pedals. Examples of this approach are disclosed in U.S. Pat. Nos.: Des. 263,490, 3,316,819, 3,529,474, 3,628,791, 3,979,302, 4,496,147, 4,600,187, 4,676,501, and 4,720,093.

In U.S. Pat. No. 4,708,388, a stair climbing apparatus is disclosed where two pedals operate independently of each other and they are connected to an alternator through a speed increasing transmission that, in turn, is connected to the pedals by a pair of chains running over a pair of one way drive sprockets. A microprocessor is used to control the alternator so that a variety of exercise programs can be implemented. However, because the pedals operate independently, the range of step motion is not measured and it is not, therefore, possible to provide the user with all the desired information, i.e., step range and effort range, regarding his exercise equipment.

Along with substantial forces exerted on the two pedals and the drive chains by users as they step up and down on the pedals, there are also sudden reversals in the pedal motion and the direction of movement of the drive chain. Thus, it has been found, results in significant wear of the drive chain as its movement is reversed from one direction to another. In addition, the drive chain, itself, encounters much friction and resistance from its interaction with other components of the stair climbing apparatus such as the sprockets over which the chain is run. This abrasion caused by the other machine parts, reduces both the life of the chain and the smoothness of the simulated motion of stair climbing to the user.

Since both the expense of changing chains and the down time of the stair climbing apparatus can be a significant cost to the owner of the stair climbing apparatus, it is desirable to increase the life of the drive chain. It is also desirable to provide the user with information regarding his exercise equipment.

SUMMARY OF THE INVENTION

It is therefore an objection of the invention to provide a reciprocating type stair climbing exercise apparatus having two pedals connected directly together where the reciprocating rate of the pedals is governed by a microprocessor controlled alternator.

It is an additional object of the invention to provide a stair climbing exercise apparatus having two foot pedals connected together by a drive chain and where an alternator is connected to the drive chain, either by a transmission or directly. Also included is a pair of one way clutches connected between the chain and the transmission such that the alternator only provides a resistance force when the pedals are operated by a user in a stair climbing direction. User comfort is enhanced by providing cross-connected cushioning or damping springs or bumpers which have the effect of limiting some portion, usually the lower portion, of the downward travel of each pedal in a resilient manner.

It is a further object of the invention to provide a stair climbing exercise apparatus having a pair of pedals that includes means for determining the relative location of each pedal during a stair climbing exercise Additionally included is a means for determining the step range of a user during a climbing exercise along with a display for displaying to the user information relating to his step range. Also displayed is a measure of the user's effort as compared to a user selected effort level.

It is a further object of this invention to provide a reciprocating type stair climbing exercise apparatus having two pedals directly connected to each other incorporating a lubricating device.

It is an additional object of this invention to provide a reciprocating type stair climbing exercise apparatus incorporating a lubricating device having two pedals connected directly together by a drive chain where the reciprocating rate of the pedals is governed by a microprocessor controlled alternator.

It is a further object of this invention to provide a stair climbing apparatus incorporating a lubricating device having two pedals directly connected together by a drive chain. Resistance to the drive chain is provided by an alternator which is either directly connected to the drive chain or is connected through a transmission to the drive chain. Furthermore, a pair of one way clutches are connected between the chain and the transmission such that the alternator only provides a resistance force when the pedals are operated by the user in a stair climbing direction. User comfort is enhanced by providing resilient cross-connected cushioning which partially limits a portion of the travel of each pedal.

It is a further object of the invention to provide a stair climbing apparatus incorporating a lubricating device having a pair of pedals and a means for determining the relative motion of each pedal during a stair climbing exercise. Further included is a means for determining the step height of a user during a climbing exercise along with a display showing the user information relating to his step height. The user's effort compared to his selected effort level can also be displayed The present invention, together with further objects and advantages, will best be understood with the detailed description read in conjunction with the accompanying drawings.

DETAILED DESCRIPTION OF THE INVENTION

Figure 1:
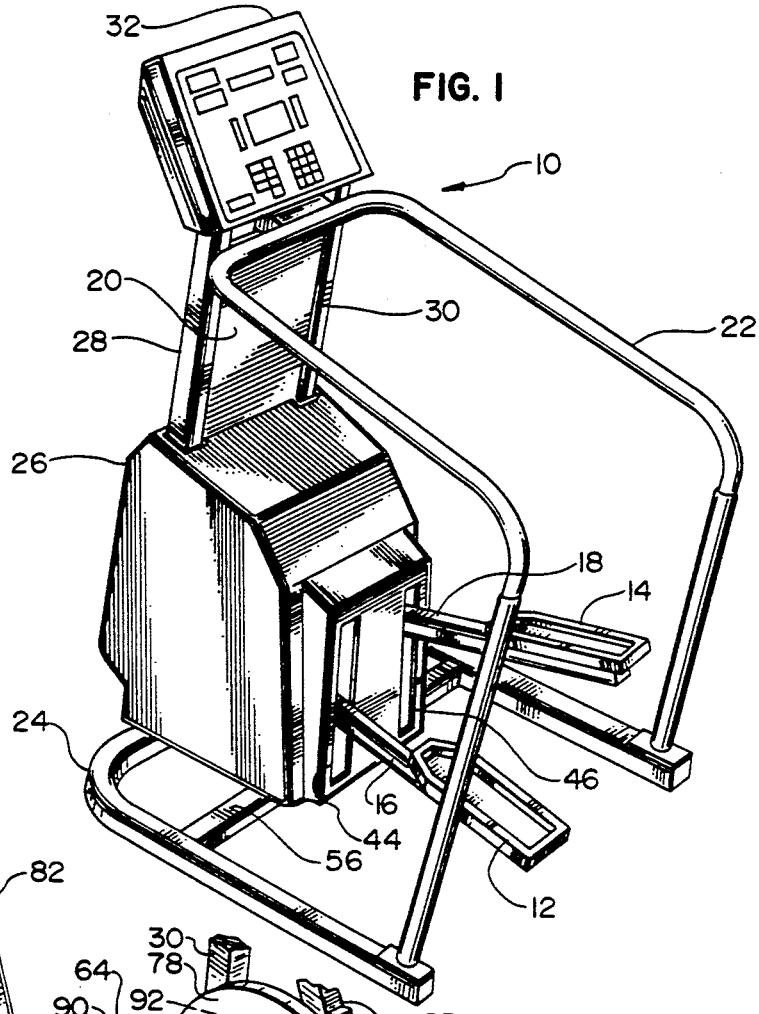
FIG. 1 is a perspective view of a stair climbing exercise apparatus constructed in accordance with the invention.

FIG. 1 provides a perspective view of a pedal type stair climbing exercise apparatus 10. A pair of foot pads 12 and 14 are attached to a pair of pedal members 16 and 18 respectively which move up and down in a reciprocating motion in order to provide a user who is standing on the pads 12 and 14 with a simulated stair climbing exercise program. Balancing support is provided to the user by a pair of handrails 20 and 22 that are secured to a U-shaped frame support base member 24 that provides support in addition to the inherent user stability resulting from connecting the pedal members 16 and 18. Also attached to the base member 24 is a housing 26 through which a pair of vertical support members 28 and 30 extend that serve to provide support for a control and display panel 32 and the handrails 20 and 22.

Figure 2:
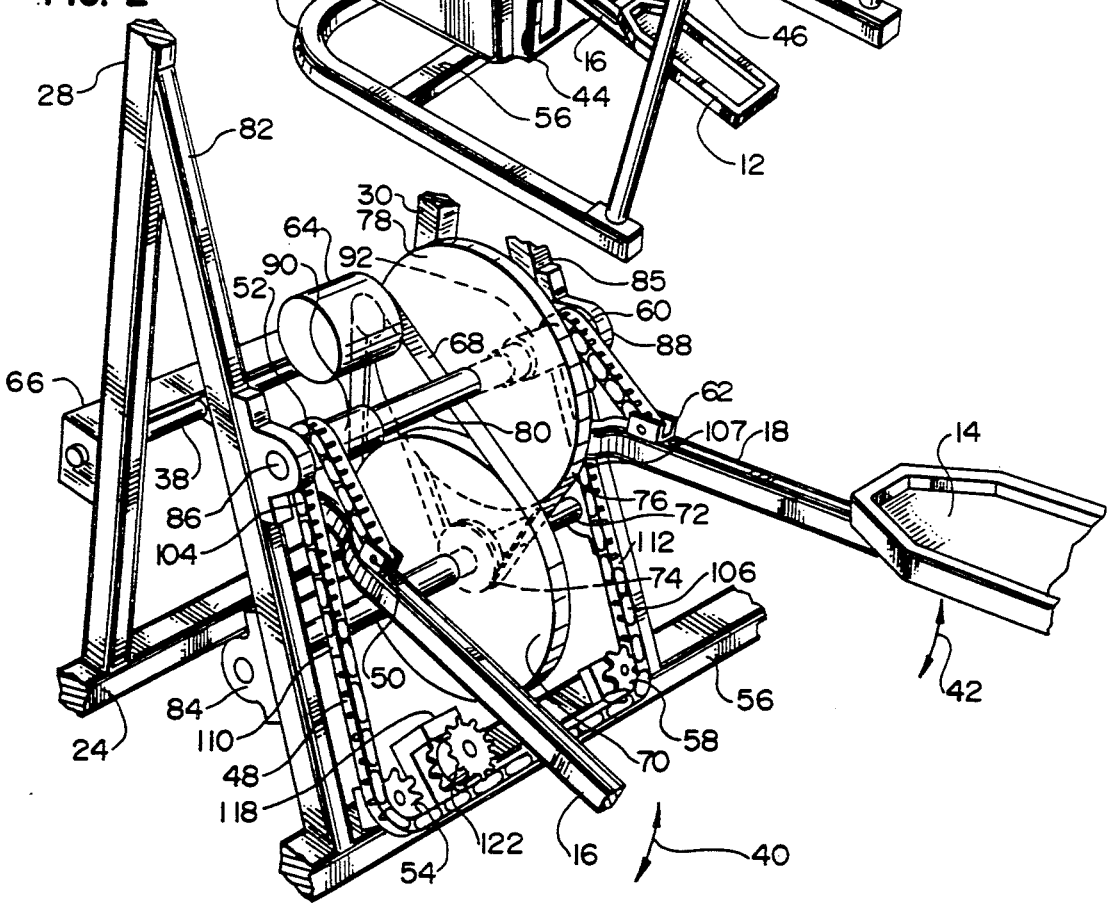
FIG. 2 is a partially sectioned away perspective view of the apparatus of FIG. 1.
Figure 3:
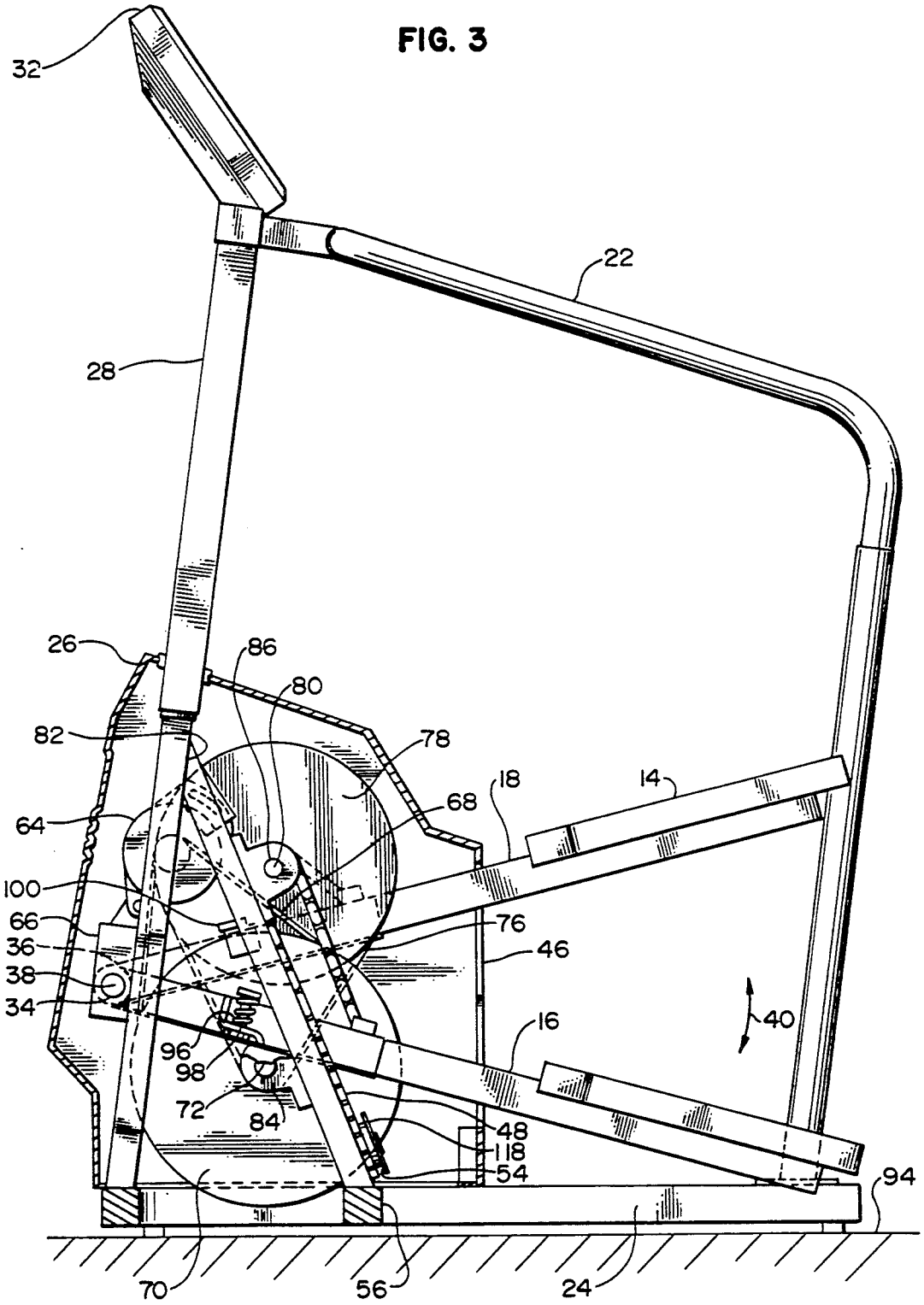
FIG. 3 is a partially sectioned side view of the apparatus of FIG. 1.

Illustrated in FIGS. 2 and 3 is a first embodiment of the mechanism contained within the housing 26 for operating the apparatus 10. As shown in these figures, the pedal members 16 and 18 are secured by a pair of bearings 34 and 36 to a rod 38 that in turn is attached to the vertical support members 28 and 30. The bearings 34 and 36 permit the pedal members 16 and 18 to angularly rotate in a vertical plane as indicated by arrows 40 and 42 in FIG. 2 through a pair of vertically aligned slots 44 and 46 in the housing 26. Since the rotation of the pedal members 16 and 18 and hence the foot pads 12 and 14 is limited to a relatively small angle, the horizontal displacement of the foot pads 12 and 14 will be relatively small so that the physical activity of stair climbing can be accurately simulated on the apparatus 10.

In this embodiment of the invention as shown in FIGS. 2 and 3, the pedal members 16 and 18 are cross connected by a linked chain 48 such that the pedal members are constrained to move in opposite directions. As a result when pedal member 16 is moving in an upward direction, pedal member 18 will be moving in a downward direction and vice versa. One end of the chain 48 is connected by a coupling 50 to the pedal member 16 and engages a first toothed sprocket 52 which leads it down to a toothed pulley 54 mounted for rotation on a frame base cross member 56. The chain 48 continues its run underneath the pedal members 16 and 18 parallel to the base member 56 to a second toothed pulley 58 rotatably secured to the base member 56. The second toothed pulley 58 serves to direct the chain 48 up to a second toothed sprocket 60 that in turn directs the chain 48 down to the pedal member 18 which is connected to the chain 48 by a coupling 62.

In order to regulate the rate at which the pedal members can be moved and thus control the rate of stair climbing, a variable source of resistance force in the form of an alternator 64 is provided. The alternator 64 is secured to a frame cross member 66 that can also be used, if desired, to attach the rod 38 to the vertical members 28 and 30. Rotational resistance is applied from the shaft of the alternator (not shown) to the chain 48 by a speed decreasing transmission which includes: a first drive belt 68 connected to a first pulley 70 coupled to a shaft 72; a second drive pulley 74 also coupled to the shaft 72; and a second drive belt 76 connecting the second drive pulley 74 to a third drive pulley 78 which is coupled to a shaft 80. Drive belts 68 and 76 are preferably micro-v belts to promote quiet operation of the apparatus 10 but drive chains or other types of power transmitting devices can be used as well. The shaft 72 is rotatably secured at one end to a frame support member 82 by a bearing 84 and at the other end by a bearing (not shown) to a second frame support member 85. Both frame members 82 and 85 are attached to the lower cross member 56 and attached respectively to the vertical supports 28 and 30. Similarly, shaft 80 is rotatably secured at either end to the frame members 82 and 84 by bearing assemblies 86 and 88. A pair of one way clutch assemblies 90 and 92 are used to connect the toothed sprockets 52 and 60 to the shaft 80. The function of the one way clutches 90 and 92 is to ensure that the shaft 80 and hence the alternator 64 only rotate in one direction even though the sprockets 52 and 60 will be rotating in both directions due to the reciprocating motion of the pedal members 16 and 18 transmitted to the chain sprockets 52 and 60 by the chain 48.

Figure 4:
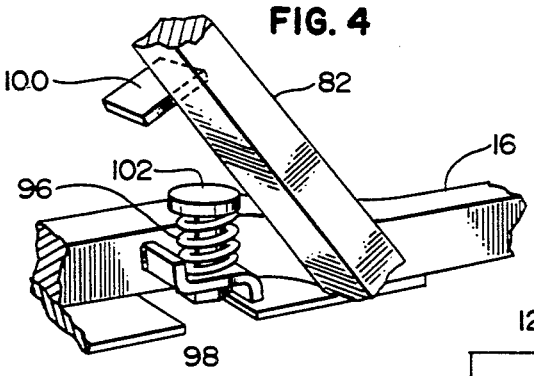
FIG. 4 is a partial detail view of the damping spring and stop shown in FIG. 3.

Another important feature of the invention is the provision as illustrated in FIGS. 3 and 4 for the cross damping of the pedal members. In order to prevent the pedal members 16 and 18 from striking the floor indicated at 94 or portions of the machine's 10 frame with undesirably high impact loads on the users legs and feet, it is considered desirable to limit the lower portion of the stroke of each pedal member 16 and 18 to prevent such impacts and further it is considered desirable to gradually reduce or dampen the velocity of the pedal members 16 and 18 as they approach the lower limit of their strokes. One approach to solving this problem involves placing springs or other resilient members under the pedal members to cushion the bottom portion of the users step motion. However, this approach has the disadvantage of producing a hitch effect in the operation of the mechanism shown in FIGS. 2 and 3. This effect occurs because the springs will cause the pedal member 16 or 18 to accelerate more quickly than the user can accelerate the opposite pedal resulting in slack in the chain 48. In the invention cross-damping is used to provide the cushioning effect while eliminating the above discussed hitch effect. As shown in FIGS. 3 and 4 a resilient member 96 such as a helical spring is attached to the upper side of each pedal member, shown for example on the pedal member 16 in FIGS. 3 and 4, by a bracket 98. A pair of stops such as the one shown at 100 in FIGS. 3 and 4 are attached to the frame support members 82 and 84. When each pedal member approaches the upper limit of its stroke the top portion of the spring, which as indicated in FIG. 4 includes a compliant elastomeric element 102, contacts one of the stops such as 100 and begins to compress thus providing the cushioning effect. But because the two pedal members are connected by the chain 48, the provision of the upper limit on the stroke of one pedal member such as 16 will effectively limit the downward portion of the stroke of the other pedal member 18. In this manner a damped lower limit can be provided for each pedal member 16 and 18 while maintaining smooth operation of the apparatus 10. It should be noted that as an alternative to the arrangement shown in FIG. 4, the spring 96 can be secured to the stop 100 and positioned so as to contact the top of the pedal member 16 at the upper limit of the stroke.

Figure 5:
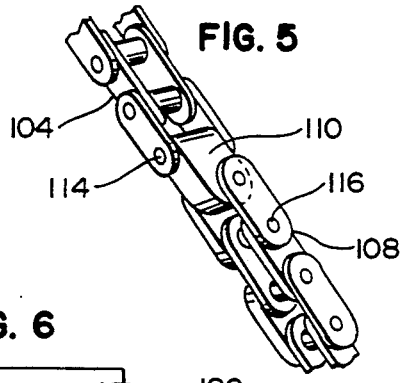
FIG. 5 is a partial detail view of a method of linking together two portions of the drive chain shown in FIGS. 2 and 3.

An additional feature of the invention is the use of a linked drive chain 48 to connect the one way clutches 90 and 92 to the pedal members 16 and 18 where the chain 48 is caused to run underneath the pedal members 16 and 18 as illustrated in FIGS. 2 and 3. This is facilitated by using a toothed composed of three separate sections. The first portion 104 of chain 48 is made up of links orientated to engage toothed sprocket 52, the second portion 106 is made up of links orientated to engage the toothed pulleys 54 and 58 which have a plane of rotation displaced ninety degrees from the toothed sprockets 52 and 60, and the third portion 108 is made up of links orientated to engage the chain sprocket 60. This ability to change the orientation of the links in the chain 48 is provided by the use of a pair of connecting links 110 and 112. Details of the connecting link 110 are shown in FIG. 5 where a pin 114 connects the chain portion 104 to the connecting link 110 and a pin 116 connects the connecting link 110 to chain portion 108.

Figure 6:
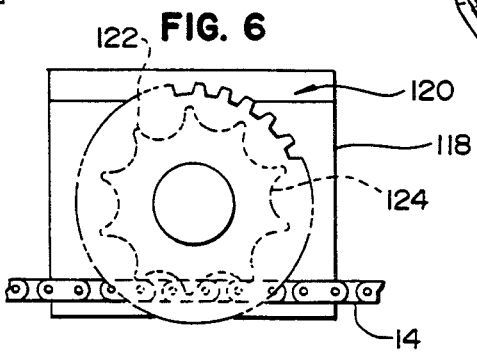
FIG. 6 is a detail view of the position sensor shown in FIGS. 2 and 3.

A positive indication of the relative motion of each of the pedal members 16 and 18 is achieved by using a position sensor 118 as illustrated in FIGS. 2 and 6. In the embodiment shown, the position sensor 118 is a conventional electro-optical device that uses a light detector to sense when toothed portions indicated generally at 120 of a disk 122 pass a light source. The disk 122 as shown in FIG. 6 can be directly connected to a sprocket indicated at 124 which is engaged with the chain 48. As suggested by FIG. 2, the sprocket 124 can be separately attached to the frame 56 or alternatively one of the pulleys 54 or 58 can be used. In this manner, a signal which provides a positive determination of the location, motion or position of the pedal members 16 and 18 can be generated.

Figure 7:
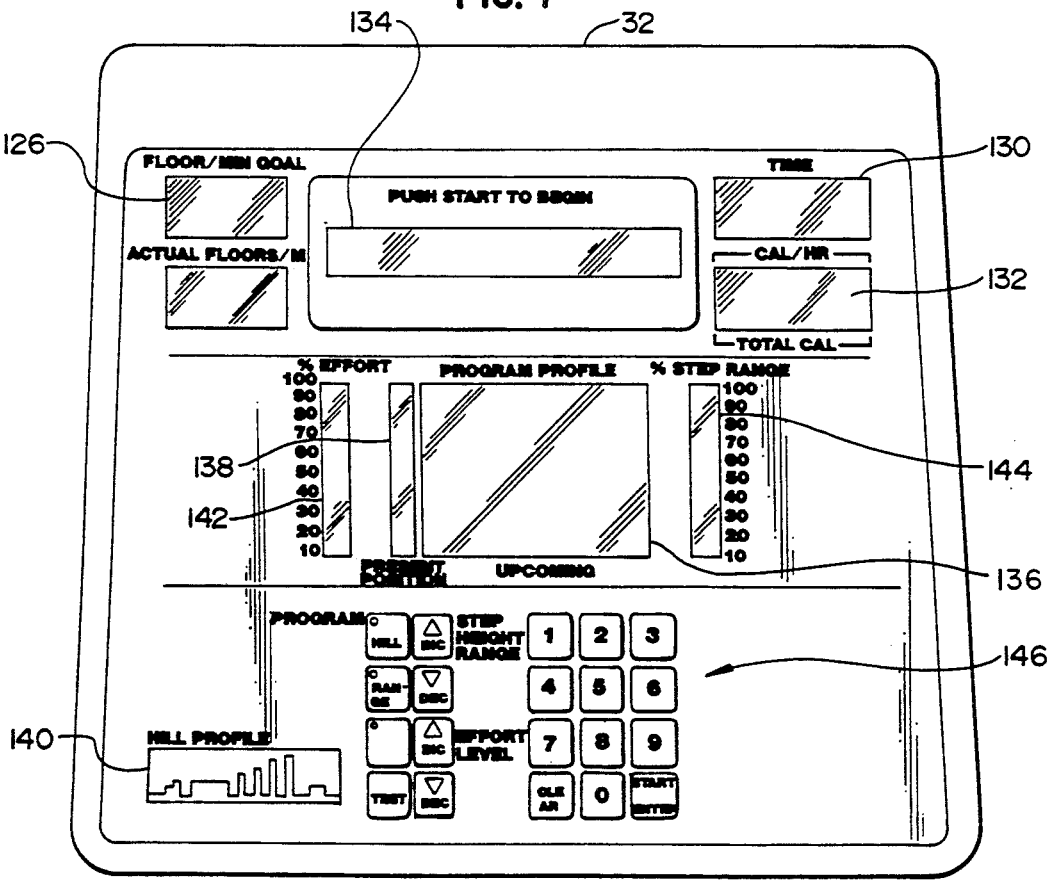
FIG. 7 is a front view of the control and display panel of the apparatus of FIG. 1.

In FIG. 7 is illustrated the preferred embodiment of the control display unit 32. The unit 32 includes a digital display of the desired rate of exercise at 126 displayed in floors per minute; a digital display at 128 of the actual rate of exercise in floors per minute; a digital display at 130 of the exercise time in minutes; and a digital display at 132 of Work performed in calories. In one embodiment of the invention the display 132 automatically switches on a periodic basis between total calories expended during the exercise program and the current rate of calorie expenditure. Also provided in the unit is an alpha-numeric display which can be used to display messages to the user including instructions on how to use the apparatus 10. A program profile display 136 including present position indication 138 is included in the unit 32 and is preferably composed of a matrix of light emitting diodes (LEDs) on which a preset exercise program such as a hill profile illustrated at 140 can be displayed. Another display is shown at 142 which can be implemented as a column of LEDs where the individual LEDs are lit in sequence to indicate to the user the percent effort that he is expending. In this case the percent effort is the percent of the actual rate of exercise as compared to the desired rate. User information with respect to the height of the steps he is simulating on the pedal members 16 and 18 is provided on another LED display 144. Here the actual displacement of the pedal members 16 and 18 as for example measured by the position sen or 118, is compared to a predetermined or user selected height or range and a percent indication is graphically displayed on the column of LEDs 144.

The control unit 32 also includes an input keyboard indicated generally at 146. The keyboard 146 can be used by the user to select various exercise programs such as the hill profile 140 or to input information into the apparatus 10 including the users weight and desired step rate. Updates of all displays is performed by a computer (not indicated in the drawings). In the preferred embodiment, the periodic update of all graphic and alpha numeric displays associated with display unit 32 is performed by a second computer 156B, using data supplied by a computer 156A through serial link 160. In addition, keyboard input is monitored by the computer 156B and the inputted data is passed to computer 156A through serial link 160.

Figure 8:
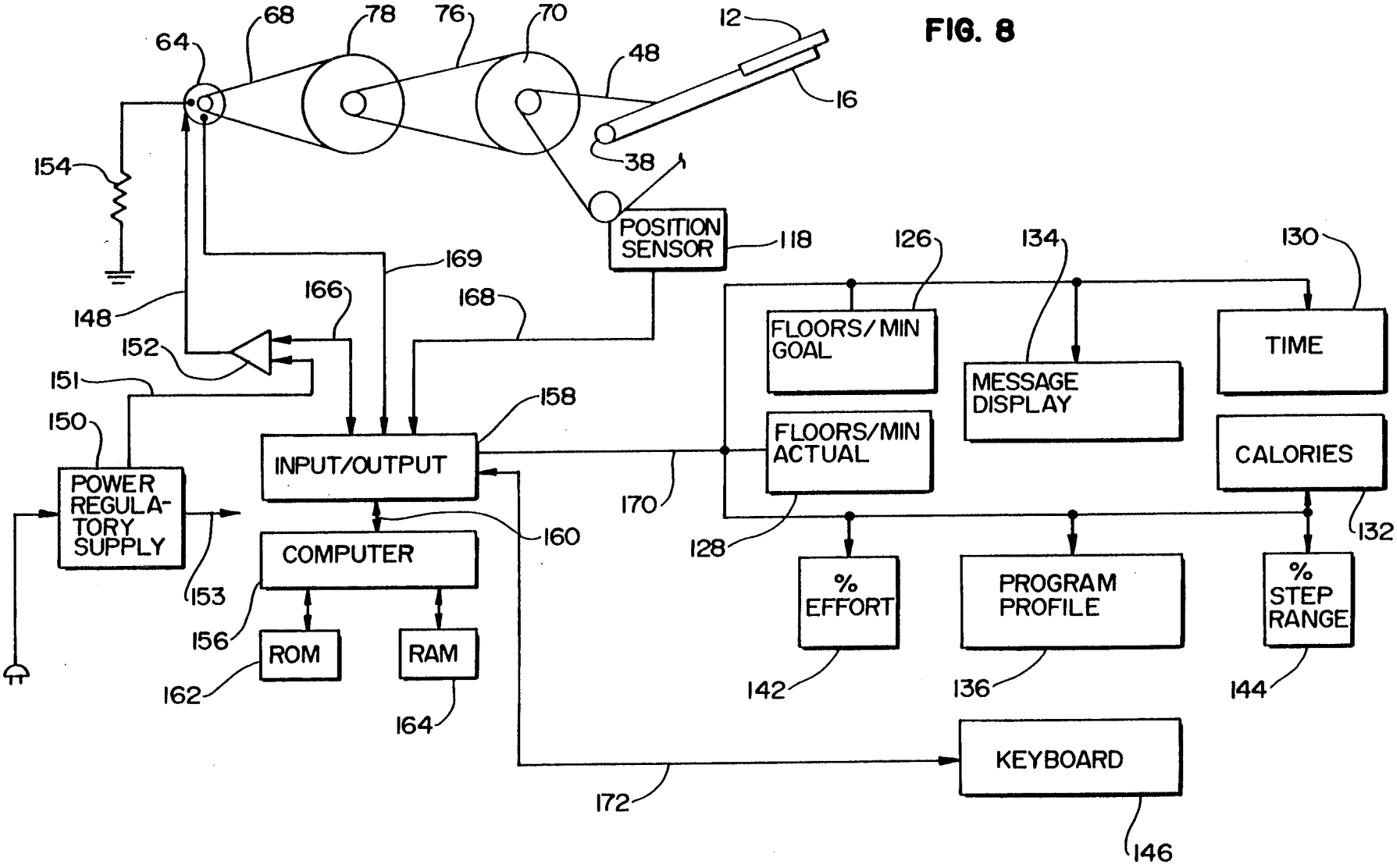
FIG. 8 is a functional block diagram of the control circuit for the apparatus of FIG. 1.

Operation of an embodiment of the invention will be described in connection with the block diagram of FIG. 8. Illustrated in schematic form are the basic mechanical elements shown in FIGS. 2 and 3 as described above. In normal operation the alternator 64 will apply a resistance force to the downward motion of the pedal member 16 through the mechanical elements 64, 68, 78, 76, 70, and 48. This resistance force is generated by the alternator 64 in response to a current applied to its field over a line 148. The field current is obtained from a power supply 150 and transmitted via a line 151 to a control amplifier 152. The power supply 150 also provides power to the various electronic elements shown in FIG. 8 as indicated by arrow 153. Current output of the alternator 64 which represents the energy being expended by the user is dissipated in a load resistor 154.

Operation of the alternator 64 is controlled by a computer 156 or in the preferred embodiment by a computer 156A. Included with the computer 156A is a nonvolatile random access memory 356 for storing machine usage data. The computer 156A controls the field current on line 148 and therefore the rotational resistance force generated by the alternator 64 by applying a control signal such as pulse width modulated signal over a line 166 to the amplifier 152. In normal operation, the computer 156A regulates the maximum step rate of the user by causing the alternator 64 to generate the maximum resistance force when the step rate approaches a predetermined rate. In an embodiment of the present invention, the computer 156A obtains pedal member position information from the position sensor 118 over a line 168 and by differentiating this information, it can calculate the users step rate. This information can also be used to compute the distance traveled by the user in terms of floors for display 126. Alternatively, a signal from the alternator's RPM sensor (not indicated in the drawings), transmitted over a line 169 to the computer 156A, can be used to determine the user's step rate and the total distance traveled. By using the rate information on line 169 as a feedback signal, the computer 156A can in essence limit the step rate by increasing the resistance force produced by the alternator 64 to the point where the user finds it very difficult to drive the pedal members 16 and 18 down faster than the predetermined rate. As an alternative, the step rate derived from position sensor 118 can also be used as the feedback signal to the computer 156A.

Also by using the position information received from the computer 156A, the second computer 156B can via line 170 generate the data to drive the various displays that were discussed in connection with FIG. 7 although computer 156A can perform these functions. For example, the computer 156A can, by simply recording the distance between the upper and the lower point of a pedal member stroke, calculate the step height for that particular stroke. This data is passed to the second computer 156B for display on the display 144 as the actual step height as a percent of a predetermined step range. Alternatively, the alternator's RPM signal on line 169 can be analyzed by the computer 156A to measure the length preferably in time of all periods of acceleration. This data, along with the average alternator RPM and the resistance force currently applied to the alternator, will yield the step height data for the display 144. The predetermined step range along with other information can be supplied from the keyboard 146, monitored by the second computer 156B, and then sent over a serial communication link 160 to the computer 156A. By the same token, the display of the rate of exercise 128 can be produced by the second computer 156B based on the information received from the alternator's RPM sensor, which is monitored by the computer 156A and then transmitted to the second computer 156B.

Position information from the sensor 118 can be used to help limit the length of strokes of the pedal members 16 and 18. For example, as one of the pedal members 16 or 18 approaches a predetermined lower limit, the computer 156A responds to the position signal on line 168 by increasing the field current of the alternator 64. The resulting increased resistance on the lower pedal member 16 or 18 will decelerate it as it approaches its lower limit thus substantially reducing the physical requirements as well as wear on the stops such as 96.

Figure 9:
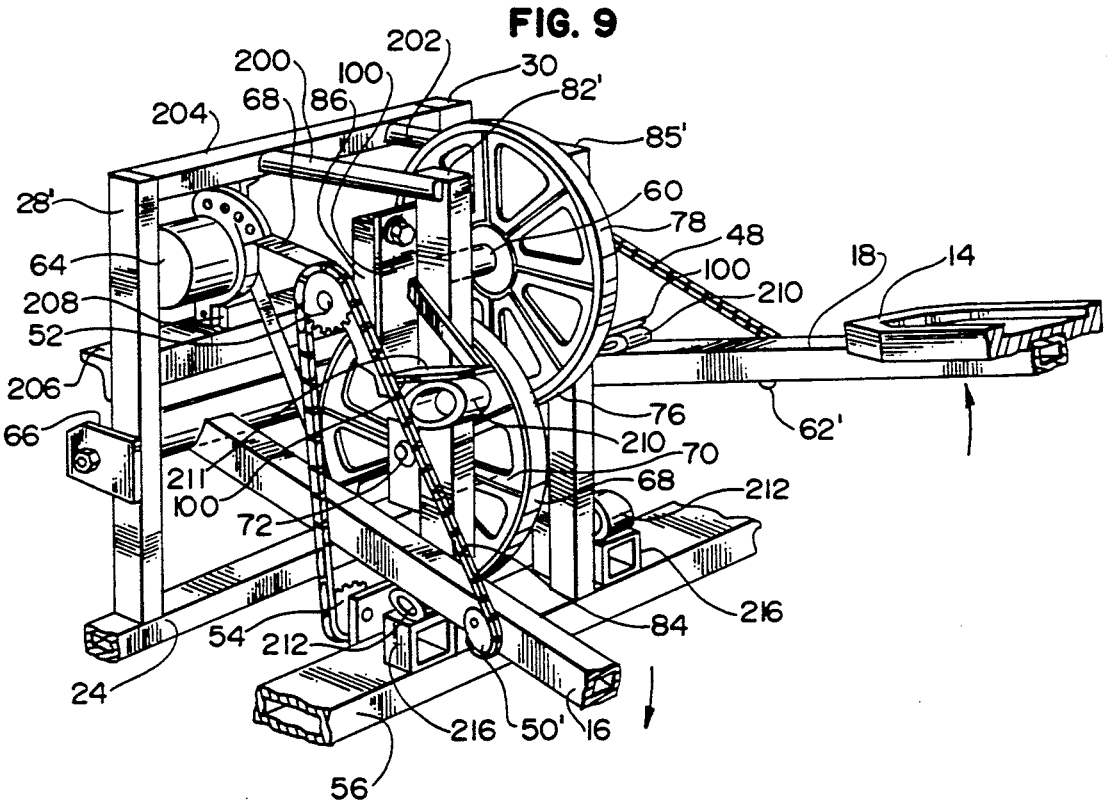
FIG. 9 is a partially sectioned away perspective view of a second embodiment of a stair climbing exercise apparatus constructed in accordance with the invention.
Figure 10:
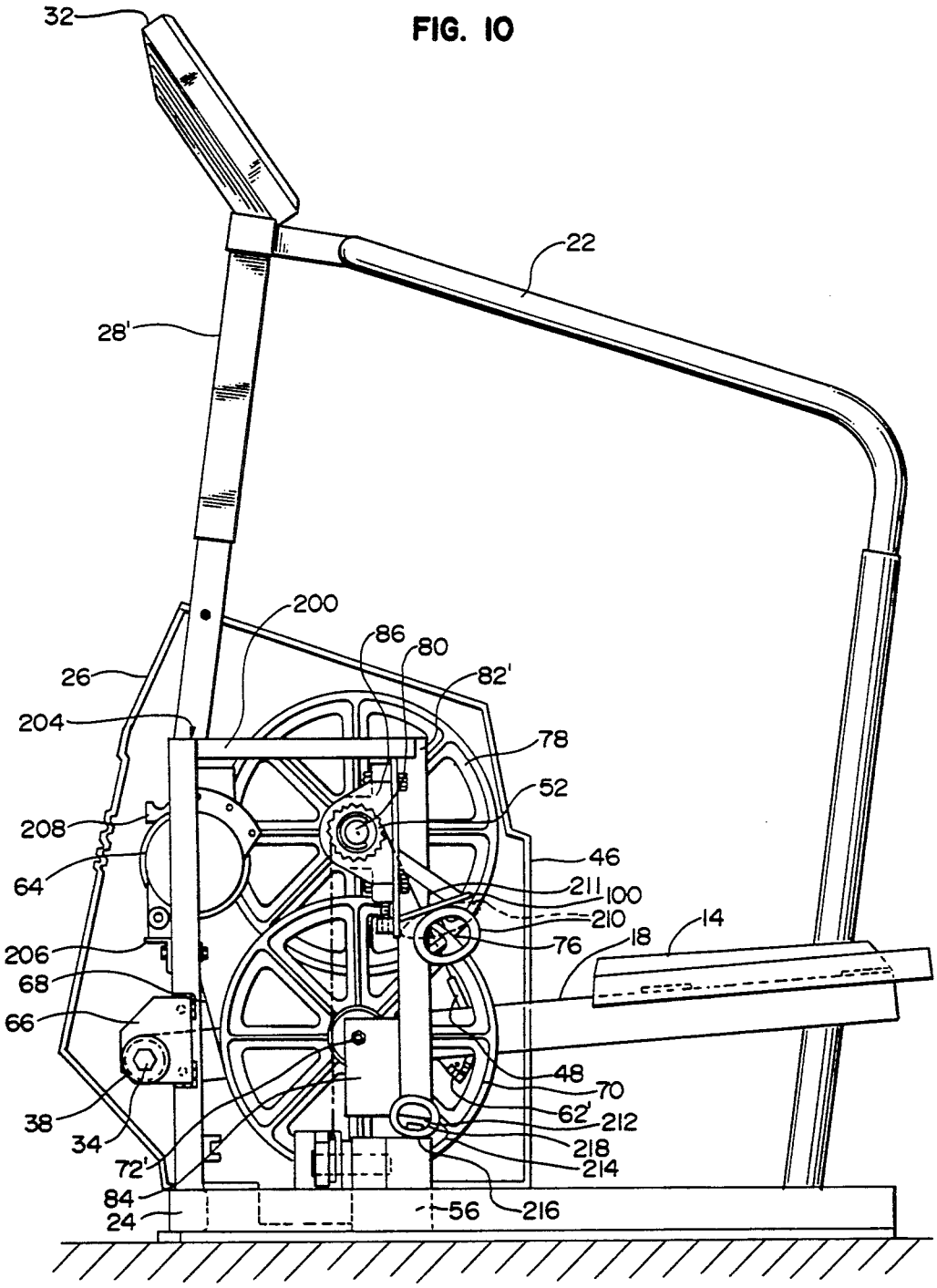
FIG. 10 is a partially sectioned view of the apparatus of FIG. 9.

Illustrated in FIGS. 9 and 10 is a second embodiment of the invention in which the elements which directly correspond to the elements in FIGS. 2 and 3 bear the same reference numbers. The pedal members 16 and 18 are cross connected by the linked chain 48 such that the pedal members are constrained to move in opposite directions. One end of chain 48 is connected by an arcuate sprocket coupling 50' to the pedal member 16, and the other end of the chain 48 is connected by an arcuate sprocket coupling 62' to the pedal member 18. Couplings 50' and 62' are mounted to a side surface of pedal members 16 and 18, rather than to the upper surface of pedal members 16 and 18, as in the first embodiment. Couplings 50' and 62' are arcuate portions of sprockets, which engage a portion of the respective ends of chain 48.

The frame support members 82' and 85' are positioned vertically, with their lower ends attached to the base frame cross members 56. At their upper ends frame members 82' and 85' are attached to a pair of horizontal frame members 200 and 202, respectively. Members 200 and 202 are attached to a horizontal frame cross member 204 which extends between the vertical frame members 28' and 30'. An additional horizontal cross member 206, such as an angle iron, is also secured between the vertical support members 28' and 30'. The shaft 72 is rotatably supported on the bearing 84' on frame member 82' and by another bearing (not shown) on frame member 85'.

The alternator 64 is mounted on a bracket 208 which extends between and is mounted to the frame cross members 204 and 206. Rotational resistance is applied from the shaft (not shown) of the alternator 64 to the chain 48 by a speed decreasing transmission, as discussed above in connection with the first embodiment.

A pair of resilient members 210 as illustrated in FIGS. 9 and 10 are secured to the stops 100 by bolts or pins 211 and positioned so as to contact the upper surface of the pedal members 16 and 18 at the upper limit of their stroke. These resilient members 210 in combination with the stops 100 provide the same cross damping function as the spring 96 which was described in connection with the first embodiment of the invention shown in FIGS. 3 and 4. A second pair of resilient members 212 are secured by bolts or pins 214 to a pair of supports 216 so as to contact the lower surface of the pedal members 16 and 18 at the lower limit of their stroke. The supports 216 are secured to the frame base cross member 56 by any conventional means, such as by welding or brazing. Resilient members 210 and 212 have a generally elliptically shaped configuration, preferably having a diameter in the range of about 0.5 to 1.0 inches. The resilient members 210 and 212 can be made from any suitable material, including polystyrene, polycarbonate, polyurethane, polyester, or mixtures thereof, and are preferably made of polyphenylene oxide. TECSPAC® bumpers, made by Eldyn, a division of Autoquip Corporation of Guthrie, Okla., and made of an Eldyn proprietary material including polyurethane and DuPont HYTREL® (polyester elastomers) have been especially useful as resilient members 210 and 212, although any other suitable material may be used. In their preferred embodiment, the resilient members 210 and 212 have a free uncompressed height in the range of 1.50 to 3.0 inches and the hardness of the material is preferably in the range of shore 30A to shore 8A; the resilient members have a compressed height in the range of 0.5 to 2.0 inches. Since the elliptical members 210 and 212 have significantly greater wear characteristics, their use is preferred over the spring 96 shown in FIG. 4. Secured to the top of each of the bolts or pins 214 is a rubber bumper 218 which provides a positive stop for the pedal members 16 and 18 and serves to reduce wear on the resilient members 212.

Figure 11:
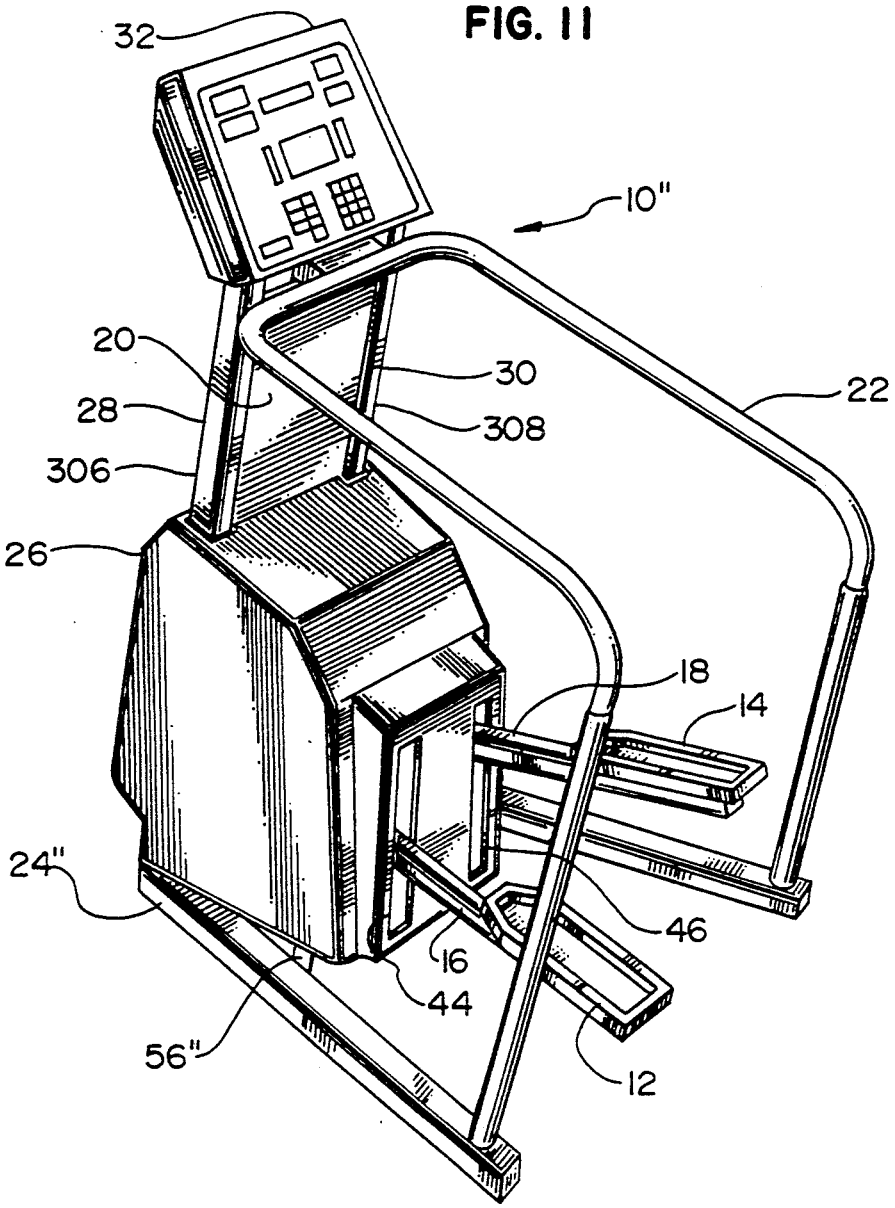
FIG. 11 is a perspective view of a stair climbing exercise apparatus constructed in accordance with the third embodiment of the present invention.
Figure 13:
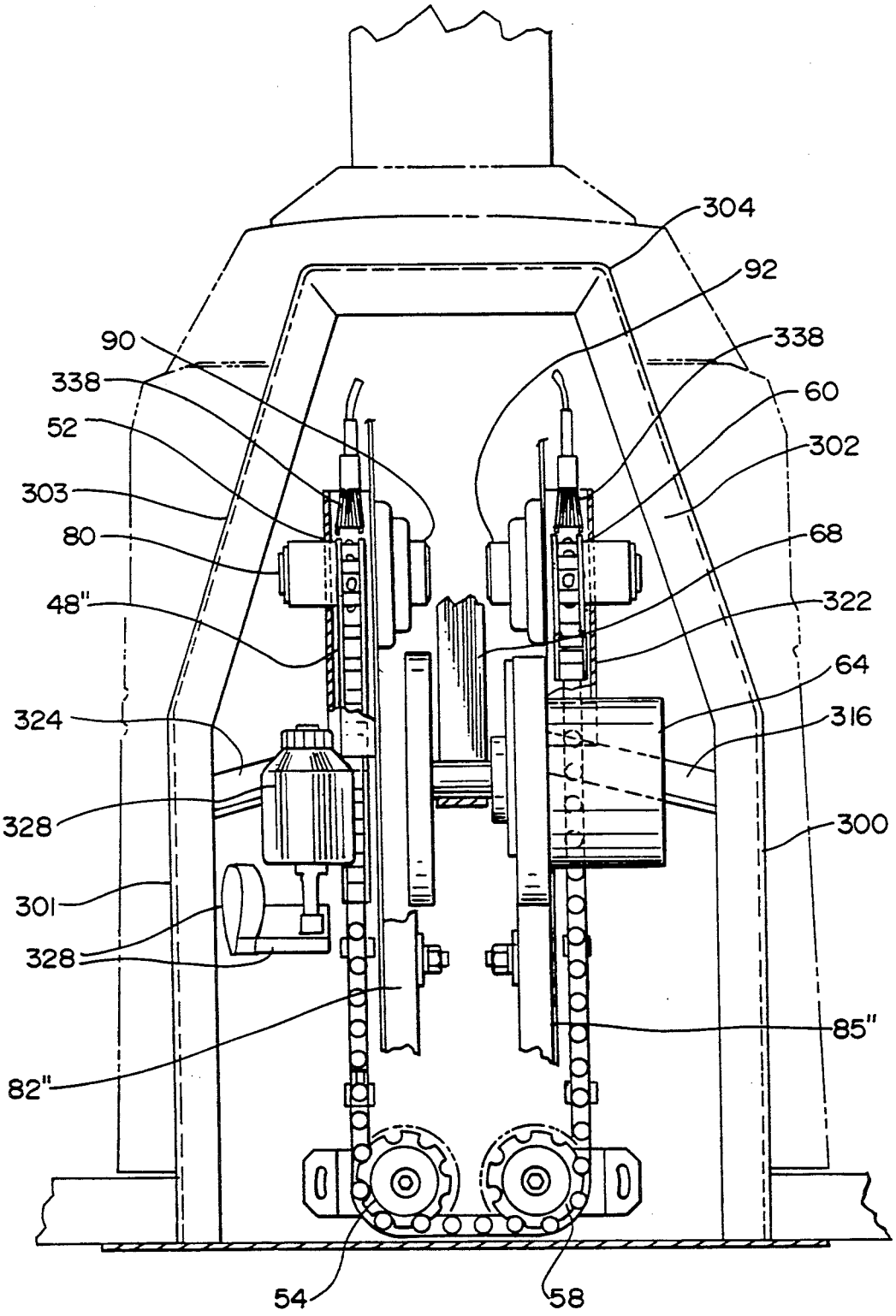
FIG. 13 is a partially sectioned front view of the apparatus of FIG. 11.

FIG. 11 provides a perspective view of a third embodiment of the invention in which the elements that directly correspond to the elements of the first and second embodiments bear the same reference numbers. As with the previously described embodiments, stair climbing exercise apparatus 10' has a pair of foot pads 12 and 14 which are attached to a pair of pedal members 16 and 18, respectively, and which move up and down in a reciprocating motion in order to provide a user who is standing on the pads 12 and 14 with a simulated stair climbing exercise program. Balancing support is provided to the user by a pair of handrails 20 and 22 that are secured to a generally V-shaped frame support base member 24". A housing 26 is also attached to the base member 24" through which the pair of vertical support members 300 and 301 extend. As shown in FIG. 13, the two vertical support members 306 and 308 each are attached to a support frame having a pair of upper portions 302, 303 respectively, which are bent inwardly from a vertical position and attached to a horizontal cross bar 304 extending from one upper portion 300 to another upper portion 302 thereby attaching the too vertical support bars 28" and 30", that together with the horizontal cross bar 304 serves to provide support for the control and display panel 32, the control and panel support bars 306, 308 upon which the control and display panel 32 is set, and the handrails 20 and 22.

Figure 12:
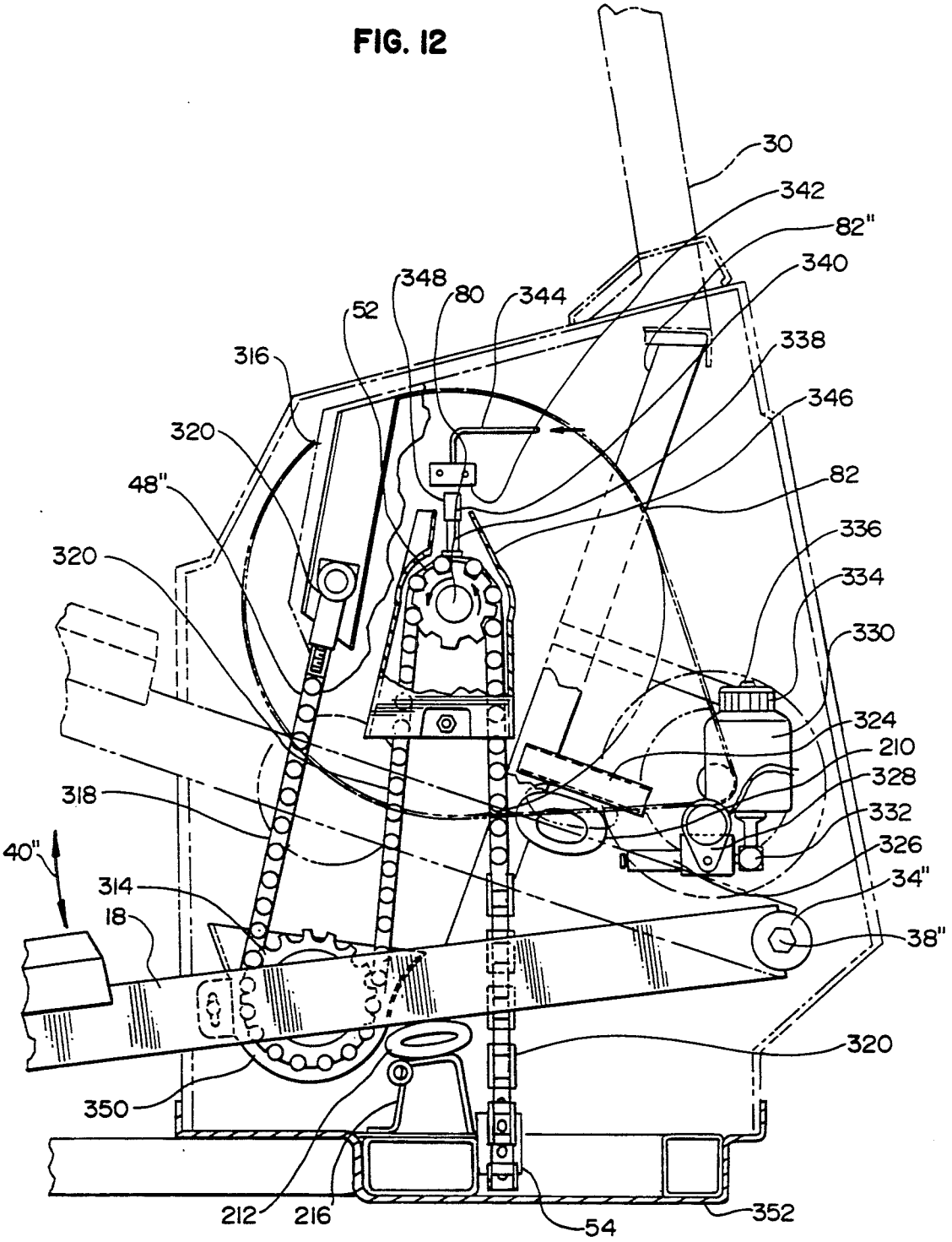
FIG. 12 is a partially sectioned side view of the apparatus of FIG. 11.

As shown in FIG. 12, the pedal members 16 and 18 are secured by a pair of bearings 34" (the second bearing is not indicated in the drawings but is similar to bearing 37") to a rod 38" that in turn is attached to the vertical support members 300 and 301 which are not shown in FIG. 12. The bearings 34" (the second bearing is not indicated in the drawings but is similar to bearing 34") permit the pedal members 16 and 18 to angularly rotate in a vertical plane as indicated by arrow 40" in FIG. 12 through a pair of vertically aligned slots 44 and 46 in the housing 26. Since the rotation of the pedal members 16 and 18 and hence the foot pads 12 and 14 is limited to a relatively small angle, the horizontal displacement of the foot pads 12 and 14 will be relatively small so that the physical activity of stair climbing can be accurately simulated on the apparatus 10'.

In this embodiment of the invention as illustrated in FIGS. 12 and 13, the pedal members 16 and 18 are cross connected by a linked drive chain 48" such that the pedal members are constrained to move in opposite directions. As a result, when pedal member 16 is moving in an upward direction, pedal member 18 will be moving in a downward direction and vice versa. Preferably, one end of the drive chain 48" is connected by a coupling 310 to a shroud 312 (shown in a partially sectioned form in FIG., 12) which is attached to a frame support member 82" which corresponds to member 82' in FIG. 10. However, the drive chain 48" can alternatively be directly coupled to the frame instead of the shroud 312. The drive chain 48" is engaged with both a rotatable toothed sprocket 314 on the pedal member 18 and the toothed sprocket 52 mounted on a shaft 80 continuing to the first toothed pulley 54 which is mounted for rotation on the frame base member 24". The chain 48" continues its run underneath the pedal members 16 and 18 parallel to the base member 24" to a second pulley 58 rotatably secured to the base member 24". This pulley 58 serves to direct the chain 48" up to second chain sprocket 60 on shaft 80 that, in turn, directs the chain 48" down over a sprocket (not indicated in the drawings but similar to the rotatable toothed sprocket 314) on the pedal member 16 to a coupling (not indicated in the drawings but similar to coupling 310) on another shroud (not indicated in the drawings but similar to shroud 312) attached to frame support member 85", to which the other end of chain 48" is connected by a coupling.

In order to regulate the rate at which the pedal members 16, 18 can be moved and thus control the rate of stair climbing, a variable source of resistance force in the form of the alternator 64 is provided. The alternator 64 is secured to an upper frame cross member 316 connected to the vertical support bar 316 and the frame support member 85". Rotational resistance is applied from the shaft of the alternator 64 to the chain 48" by a transmission which includes: a first drive belt 68 connected to a first pulley (not indicated in the drawings) coupled to a second shaft (not shown); a second drive pulley (not indicated in the drawings) also coupled to the second shaft (not indicated in the drawings); and a second drive belt (not indicated in the drawings) also coupled to the second shaft (not indicated in the drawings) and a second drive belt (not indicated in the drawings) which is coupled to a shaft 80. The first and second drive belts are preferably micro-v belts which promote quiet operation of the apparatus 10" but drive chains, cables, belts, such as cog belts, or other types of power transmitting devices can be used equally as well. The second shaft (not indicated in the drawings) is rotatably secured at one end to the frame support member 82" by a bearing and at the other end by a bearing (not indicated in the drawings) to a second frame support member 85". Both frame members 82" and 85" are attached to the lower cross member 56" and to the vertical supports 28" and 30" respectively. Similarly, shaft 80 is rotatably secured at either end to the frame members 82" and 85" by bearing assemblies (not indicated in the drawings). A pair of one way clutch assemblies 90 and 92 are used to connect the toothed sprockets 52 and 60 to the shaft 80. The function of the one way clutches 90 and 92 is to ensure that the shaft 80 and hence the alternator 64 only rotate in one direction even though the chain sprockets 52 and 60 will be rotating in both directions due to the reciprocating motion of the pedal members 16 and 18 transmitted to the sprockets 52 and 60 by the chain 48".

In addition, the linked drive chain 48" used to connect the one way clutches 90 and 92 to the pedal members 16 and 18 runs underneath the pedal members 16 and 18 as illustrated in FIGS. 12 and 13. This is facilitated by using a chain composed of three separate sections The first portion 318 of the drive chain 48" is made up of links orientated to engage the rotatable toothed sprocket 314 and chain sprocket 52; the second portion 320 is made up of links orientated to engage the toothed pulleys 54 and 58 which have plane of rotation displaced ninety degrees from the sprockets 52 and 60, and third portion 322 is made up of links orientated to engage the toothed sprocket 60 on the clutch 92 and the rotatable toothed sprocket on pedal member 16. This ability to change the orientation of the links in chain 48" is provided by the use of a pair of connecting links 110 and 112. Details of the connecting link 110 are shown in FIG. 5.

Another important feature of this third embodiment of the invention is the provision as illustrated in FIG. 12 for cross damping of the pedal members. To prevent the pedal members 16 and 18 from striking the floor portions of the stair climbing apparatus 10" with undesirably high impact loads on the users legs and feet, it is considered desirable to limit the lower portion of the stroke of each pedal member 16 and 18 to prevent such impacts. Further, it is desirable to gradually reduce or dampen the velocity of the pedal members 16 and 18 as they approach both the lower and upper limits of their strokes.

To prevent pedal members from reaching the upper limits of their strokes, a pair of resilient members 210 as illustrated in FIG. 12 are utilized. The resilient members 210 are secured to the upper cross frame members 316, 324 by bolts or pins or any other suitable means so as to contact the upper surface of the pedal members 16 and 18 at the upper limit of their stroke. A second pair of resilient members 212 are secured by bolts, pins or any other suitable means to a pair of supports 326 so as to contact the lower surface of the pedal members 16 and 18 at the lower limit of the pedal stroke. The supports 326 are secured to the frame base cross member 56 by any conventional means, such as by welding or brazing. Although the spring means disclosed above in connection with the first and second embodiments can be utilized, it is preferred to utilize the resilient members having a generally elliptically shaped configuration as disclosed in FIGS. 12 and 13.

Another important feature of this invention illustrated with respect to the third embodiment, but applicable to all embodiments of the present invention, is a lubricating arrangement which reduces wear on the drive chain 48". A variety of lubricants are contemplated by this invention to lubricate the drive chain 48". For example, non-detergent, synthetic oil with additives can be utilized. However, the preferred embodiment utilizes a 30 weight non-detergent motor oil.

Figure 15:
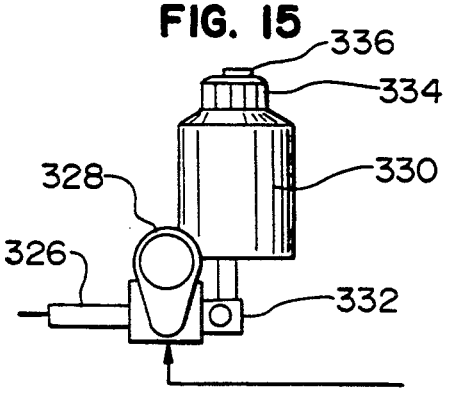
FIG. 15 is a perspective view of the lubricating device of the present invention.

To dispense the fluid onto the chain 48", a positive displacement pumping system is utilized. In the preferred embodiment, two pumps 326 are utilized for simplicity only one pump is illustrated in FIGS. 12, 13 and 15, but it is understood that there are two pumps having the same general configuration and relative location in the apparatus. The pumps 326 are preferably single feed injector pumps made by Oil-Rite Corporation, Catalog No. B-2833 and are powered by an electric motor 328. The pumps 326, together with the motor 328, are secured by a support bracket 329 to vertical support bars 306 and 308. Each pump 326 separately applies the lubricating fluid onto the drive chain 48" on each side of the apparatus thereby permitting a single uniform and equal amount of lubricating fluid to be applied to the chain 48" on each side of the apparatus. It is also understood that a single pump can be utilized to pump fluid, however, because a single pump cannot be as finely adjusted to provide equal amounts of lubricating fluid to the drive chain 48" on each side of the apparatus as two pumps, two separate pumps 326 are used in the preferred embodiment. Both of the pumps 326 are in fluid communication with a reservoir 330. Any number of methods can be used to connect the reservoir 330 to the two pumps 326 such as plastic tubing. However, it has been found that it is preferable to use an elbow coupling 332 to fluidly connect the pumps 326 to the reservoir 330. The reservoir 330, itself, has a top gasket 334 and a check valve 336 which permits the egress of air bubbles out of the reservoir 330, and at the same time prevents contaminants from entering the reservoir. Optionally, the reservoir 330 can be provided with a spring loaded piston to pressurize the lubricating fluid thereby aiding the flow of the oil out of the reservoir. Of course, as one skilled in the art would recognize, other dispensing means such as gravity feed systems controlled by solenoid valve systems can be used in lieu of the pumps.

As shown in FIGS. 12 and 13, the two pumps 326 pump the lubricating fluid to elements capable of applying oil onto the drive chain 48". For applying oil onto the drive chain 48", a wide variety of methods can be used such as brush, roller, drip and spray. In the preferred embodiment, a pair of brushes 338 having bristles preferably composed of nylon are used to apply the lubricating fluid onto the drive chain 48".

The brushes 338 are supported by a pair of metal sleeves 340. The sleeves 340 are secured to the shroud 312 by a bracket 346 and are each connected to tubing 344. The tubing 344 is connected to the pumps 326, thereby providing a method to supply the brushes 338 with lubricating fluid. The brushes 338 are located so as to brush the upper-most portions of the chain 48" to apply lubricant to the chain 48" as it runs over the various sprockets. The brushes 338 are secured in such a manner that they just lightly touch the chain 48" so as to be effective in applying lubricant to the chain 48". In addition, the brushes 338 are also located in a manner sufficient to keep the chain 48" from slipping off the toothed sprockets 52 and 60. The brushes 338 do not press down on the drive chain 48" in order to permit the drive chain 48" to transverse the toothed sprockets 52 and 60, but at the same time, the brushes 338 are located just above the drive chain 48" to prevent the drive chain 48" from slipping off the sprockets 52 and 60.

In addition to using brushes 338, other structure is provided to keep the drive chain 48" from slipping during the operation of the apparatus. A splash cover 346 is provided for each sprocket 52 and 60 for the purpose of preventing the lubricant from being sprayed on other parts of the mechanism which results from the rotation of the chain 48" over the sprocket 52. The splash cover 346 has an aperture 348 for receiving the brush 338 and sleeve 340. Together with the brushes 338, the splash covers 346 also prevent the slippage of the drive chain 48" from either sprocket 52 and 60.

An additional pair of splash covers 350 is utilized to prevent the spraying of lubricant from the drive chain 48" as it rotates over the sprocket 314 on each pedal member 16, 18. Similarly, each pulley 54, 58 is positioned just above a drip tray 352 to allow free movement of the drive chain 48", but close enough to the drip tray 352 to collect the lubricant from the drive chain 48". In addition to its use for collecting lubricant, the tray 352 is positioned close enough to the drive chain 48" to prevent slippage of the drive chain 48" from each pulley 54, 58. The drip tray 352 is secured to a bottom portion of the apparatus 10".

Figure 14:
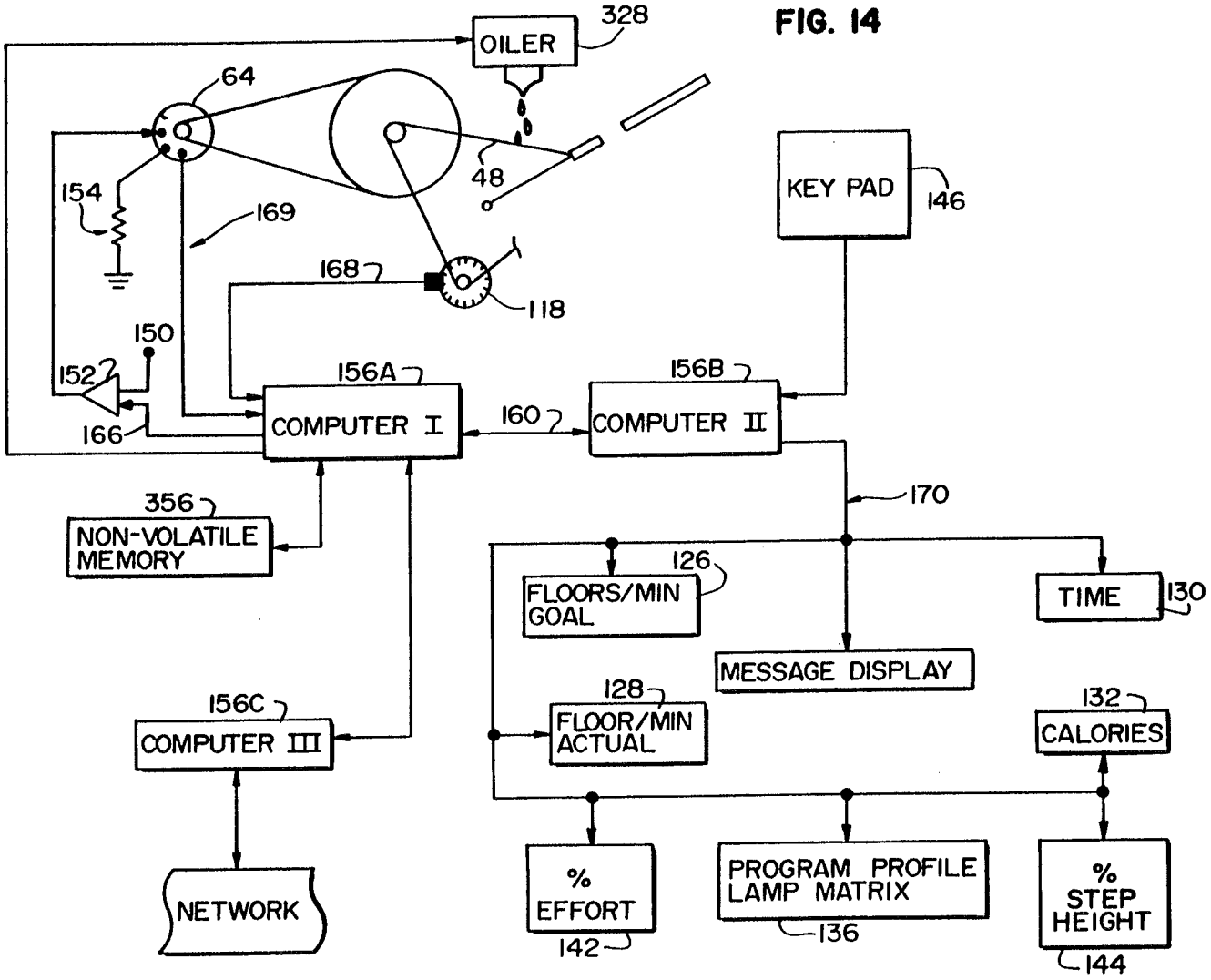
FIG. 14 is a functional block diagram of the control circuit of the apparatus of FIG. 11.

Operation of the third embodiment of the present invention will be described in connection with the block diagram of FIG. 14. Illustrated in schematic form are the basic mechanical elements shown in FIGS. 12 and 13 as described above. In normal operation, the alternator 64 will apply a resistance force to the downward motion of the pedal member 16 through a speed increasing transmission. This resistance force is generated by the alternator 64 in response to a current applied to its field over a line 148. The field current is obtained from a power supply 150 and transmitted via a line 151 to a control amplifier 152. The power supply 150 also provides power to the other various electronic elements. Current output of the alternator 64 may be dissipated in a load resistor 154 when the user exceeds a predetermined maximum step rate. The user's energy is absorbed by the mechanical components of the apparatus 10" except when the user exceeds the maximums step rate.

The alternator 64 and the lubricating means 328 are controlled by computer 156A. In the preferred embodiment, step rate information is transmitted over a line 169 from a tachometer or a rpm sensor in the alternator 64 to the computer 156A. The user's step rate can then be translated into any one of several measurements. For example, the computer 156A can, by simply recording the user's step rate, calculate the step range for that particular stroke or compute the distance traveled by the user in terms of floors. The information generated from alternator enables the computer 156 to operate through an input/output unit 158 via the lines indicated at 160 and 182.

In order to control the alternator 64, the computer 156A contains a read only memory for storing both the preset exercise programs and the control instructions and a random access memory for storing user exercise data. In normal operation, a signal from the alternator's rpm sensor is transmitted over the line 169 to the computer 156A. After utilizing the instructions from its read-only memory and the data from its random access memory, the computer 156A controls the alternator 64, by applying a control signal such as a pulse width modulated signal over a line 166 to the amplifier 152. In this way, computer 156A governs the field current on line 148 and thus the rotational resistance force generated by the alternator 64.

By using the step rate information transmitted on line 169 as a feedback signal, the computer 156A also regulates the maximum step rate of the user by causing the alternator 64 to generate the maximum resistance force when the step rate approaches a predetermined rate. In essence, the computer 156A can limit the step rate by increasing the resistance force produced by the alternator 64 to the point where the user finds it very difficult to drive the pedal members 16 and 18 down faster than the predetermined rate. Thus the alternator 64 is set up to supply a resistance force when the user begins to exceed the predetermined rate, such as when the user begins to exceed the predetermined rate by 20%. Step rate information from the alternator can also be used to help limit the length of strokes of the pedal members 16 and 18. For example, as one of the pedal members 16 or 18 approaches a predetermined lower limit, the computer 156A responds to the position signal on line 168 by increasing the field current of the alternator 64. The resulting increased resistance on the lower pedal member 16 or 18 will decelerate it as it approaches its lower limit thus substantially reducing the user's physical exertions as well as wear on the stops such as 96.

In addition, the step rate information can be translated into a variety of data and transmitted to computer 156B for display on the control and display means 144 to the user. By using the information supplied by computer 156A, the computer 156 can via line 170 generate the various displays that were discussed in connection with FIG. 7 such as the number of floors per minute, the actual step range as a percent of a predetermined step range, the rate of exercise and the amount of calories burned by the user. Moreover, the predetermined step range along with other information can be supplied from the keyboard 146 over a line 172 to computer 156B. This data can then be transmitted over serial link 160 to computer 156A.

The measurements taken from the alternator 64 also help the microcompressor 156A to regulate the dispensing of the lubricating fluid onto the drive chain 48". The computer 156A controls the operation of the electric motor 328 for each pump via the lines indicated at 354. Included with the microprocessor 156A is a non-volatile memory 356 for storing machine usage and lubrication schedule data. The processor 156A controls the electric motor 328 which actuates the pumps 326.

In normal operation, the computer 156A actuates the electric motor 328 of the pumps 326 when a predetermined number of floors are traversed by the pedals 16, 18. The floors climbed may be calculated by algorithms incorporating the acceleration or deceleration of each pedal 16, 18. The acceleration and deceleration of each pedal 16, 18 is stored and added to the previous corresponding value for each step 16, 18. These values are then stored until the necessary number of floors to activate the dispenser are reached. The dispensing system can be activated by the computer 156A as desired by the user. Most preferably, the dispensing system is actuated every 1,000 floors. If a gravity system is utilized in lieu of a mechanized dispenser, the dispensing system is also activated about every 1000 floors although this number can be altered depending upon user preference. In addition, the computer 156A can also be programmed to increase the amount of lubricant pumped after a predetermined number of floors have been traversed. For example, lubricant can be pumped at a constant rate every 1,000 floors and after the number of floors reaches 1,000,000 floors, the amount of lubricant pumped can be adjusted. Optionally, the computer 156A can be programmed to activate the dispensing means after the apparatus 10" has been used for a predetermined time period or any other desirable variable as one skilled in the art would recognize.

Upon activation, the motor 328 runs for a time frame sufficient to pump enough lubricating fluid to adequately grease the drive chain 48". Varying amounts of fluid can be used depending upon a number of factors such as chain length, amount of use of the apparatus 10" and the time intervals between lubrication. Preferably, 0.040 ml. of lubricating fluid are dispensed onto the drive chain 48 for every 1,000 floors although other amounts depending on usage and preference can be utilized.

We claim:

1. A stair climbing exercise apparatus comprising:

a frame;

a first pedal member pivotally secured to said frame for rotational movement in a vertical direction;

a second pedal member pivotally secured to said frame for rotational movement in a vertical direction;

an alternator, having a shaft and a control field, secured to said frame;

control means operatively connected to said alternator and said pedal members for applying a control current to said alternator control field in response to the rate of rotational movement of said pedal members; and connection means for directly connecting said first pedal member to said second pedal member such that said pedal members are limited to said rotational movement in opposite directions and for connecting said pedal members to said alternator shaft such that said alternator is effective to apply a resistance force opposing said pedal member movement.

2. The apparatus of claim 1 wherein said connection means includes a drive chain attached at one end to said first pedal member and attached at the other end to said second pedal member and transmission means for connecting said drive chain to said alternator shaft.

3. The apparatus of claim 2 wherein said connection means includes a first one way clutch operatively interposed between said drive chain and said transmission means effective to rotate said transmission means in a first direction when said first pedal member is moving downwardly and a second one way clutch operatively interposed between said chain and said transmission means effective to rotate said transmission in said first direction when said second pedal member is moving downwardly.

4. The apparatus of claim 3 wherein said connection means includes a first shaft rotationally secured to said frame and secured to said first and second one way clutches and said transmission means.

5. The apparatus of claim 4 wherein said connection means includes a first and a second sprocket pulley rotationally secured to a lower portion of said frame for engaging and leading said drive chain from said first one way clutch under said pedal members to said second one way clutch.

6. The apparatus of claim 5 wherein said one way clutches include chain sprockets engaged with said drive chain and wherein the rotational plane of said sprocket pulleys are orientated approximately 90 degrees to the rotational plane of said chain sprockets.

7. The apparatus of claim 6 wherein said drive chain includes: a first portion attached to said first pedal member and having links engaged with said first chain sprocket; a second portion attached to said first portion including links orientated at a 90 degree angle to said first portion links and engaged with said sprocket pulleys; and a third portion attached to said second portion and said second pedal member including links orientated at a 90 degree angle to said second portion links and engaged with said second chain sprocket.

8. The apparatus of claim 7 wherein said transmission means includes a first pulley secured to said first shaft, a second pulley attached to a second shaft which is rotatably attached to said frame, a first drive belt connecting said first pulley to said second shaft and a second drive belt connecting said second pulley to said alternator shaft.

9. The apparatus of claim 1 additionally including position means operatively connected to said pedal members for generating a position's signal representing the rotational position of said pedal members.

10. The apparatus of claim 9 wherein said position means is operatively connected to said control means and includes rate means for generating a rate signal representing the rate of rotational motion of said pedal members.

11. The apparatus of claim 10 wherein said control means responds to said rate signal to increase said field current to a predetermined level when said rate of rotational motion reaches a preselected rate.

12. The apparatus of claim 11 additionally including display means operatively connected to said control means for displaying a step range indication in response to said position signal.

13. The apparatus of claim 5 additionally including a position sensor operatively connected to said first sprocket pulley and said control means for generating a position signal representing the rotational position of said pedal members.

14. The apparatus of claim 13 wherein said control means includes means for generating said alternator field current as a function of the rate of change of said position signal.

15. The apparatus of claim 1 additionally including cross-connected damping means for resiliently damping the upward motion of each of said pedal members as it approaches a predetermined upper limit of said rotational movement.

16. The apparatus of claim 15 wherein said cross-connected damping means includes a resilient member secured to each of said pedal members and a pair of stops secured to said frame configured to receive each of said resilient members as its respective pedal member approaches said predetermined upper limit.

17. The apparatus of claim 16 wherein said resilient members are helical compression springs.

18. The apparatus of claim 15 wherein said cross-connected damping means includes a pair of resilient members secured to said frame such that one of said resilient members compressibly contacts each of said pedal members as it approaches said predetermined upper limit.

19. The apparatus of claim 18 wherein said resilient members are helical compression springs.

20. The apparatus of claim 18 wherein at least one of said resilient members are composed of a material selected from the group consisting of polyphenylene oxide, polystyrene, polycarbonate, polyurethane, polyester, or mixtures thereof.

21. The apparatus of claim 20 wherein at least one of said resilient support members has a generally donut shape.

22. The apparatus of claim 20 wherein said resilient support members have a height in the range of approximately 1 to 1½ inches.

23. The apparatus of claim 1 additionally including first cross-connected damping means for resiliently damping the upward motion of each of said pedal members it approaches a predetermined upper limit of said rotational movement, and additionally including second cross-connected damping means for resiliently damping the downward motion of each of said pedal members as it approaches a predetermined lower limit of said rotational movement.

24. The apparatus of claim 22 wherein at least one of said cross-connected damping means includes a pair of resilient members secured to said frame such that each said resilient members compressibly contacts a different approaching pedal member.

25. The apparatus of claim 23 wherein both of said cross-connected damping means includes a pair of resilient members secured to said frame such that one of said resilient members compressibly contacts a pedal member as it approaches a predetermined upper limit and a predetermined lower limit of said rotational movement.

26. The apparatus of claim 23 wherein said resilient member is composed of a material selected from the group consisting of polyphenylene oxide, polystyrene, polycarbonate, polyurethane, polyester, or mixtures thereof.

27. The apparatus of claim 25 wherein at least one of said resilient support members has a generally donut shape.

28. The apparatus of claim 26 wherein said resilient support members have a height in the range of approximately 1 to 1½ inches.

29. The apparatus of claim 1 wherein said control means responds to a rate signal from said alternator to increase said field current to a predetermined level when the rate of rotation of said alternator reaches a preselected rate.

30. A stair climbing exercise apparatus comprising:

a frame;

a first pedal member pivotally secured to said frame for rotational movement in a vertical direction;

a second pedal member pivotally secured to said frame for rotational movement in a vertical direction;

an alternator, having a shaft and a control field, secured to said frame;

control means operatively connected to said alternator and said pedal members for applying a control current to said alternator control field in response to the rate of rotational movement of said pedal members; and connection means for directly connecting said first pedal member to said second pedal member such that said pedal members are limited to said rotational movement in opposite directions including a drive chain operatively connected between said first pedal member and said second pedal member, and including transmission means for connecting said drive chain to said alternator shaft, said connection means includes a first shaft rotationally secured to said frame and secured to a first one way clutch operatively interposed between said drive chain and said transmission means effective to rotate said transmission means in a first direction when said first pedal member is moving downwardly and to a second one way clutch operatively interposed between said drive chain and said transmission means effective to rotate said transmission in said first direction when said second pedal member is moving downwardly, and said transmission means includes a first pulley secured to said first shaft and a drive belt connecting said first pulley to said alternator shaft.

31. The apparatus of claim 30 wherein said drive chain is attached at each end to said frame, and engages therebetween first and second sprockets on said first and second pedal members, respectively.

32. The apparatus of claim 31 wherein said first and second sprockets engage and lead said drive chain to said first and second one way clutches, respectively.

33. A stair climbing exercise apparatus comprising:

a frame;

a first pedal member pivotally secured to said frame for rotational movement in a vertical direction;

a second pedal member pivotally secured to said frame for rotational movement in a vertical direction;

connection means for directly connecting said first pedal member to said second pedal member such that said pedal members are limited to said rotational movement in opposite directions and for connecting, including a drive chain cooperative connected between said first pedal member and said second pedal member; and chain tensioning means for absorbing slack in at least a portion of the length of said drive chain during said rotational movement of said first and second pedal members wherein said chain tensioning means includes a sprocket mounted to said frame, said sprocket being biased towards and engaging said drive chain.

34. The apparatus of claim 33 wherein said sprocket is mounted at one end of a lever arm, with said lever arm mounted for pivotal movement on said frame.

35. The apparatus of claim 34 wherein said sprocket is biased towards said drive chain by a compression spring between said frame and said lever arm.

36. A stair climbing exercise apparatus comprising:

a frame;

a first pedal member to support one foot of a standing user, said first pedal member being pivotally connected to said frame for rotational movement in a vertical direction;

a second pedal member to support the other foot of a standing user, said second pedal member being pivotally connected to said frame for rotational movement in a vertical direction; and position means operatively associated with at least one of said pedal members for generating a signal representing the rotational positions of said pedal member.

37. The apparatus of claim 36 additionally including a display means responsive to said position signal for generating a display representing the range of pivotal motion of said pedal members.

38. The apparatus of claim 36 including resistance means operatively connected to said pedal members for generating a resistance force opposing the rotational motion of said pedal members and a control means responsive to said position signal and operatively connected to said resistance means for controlling said resistance means.

39. The apparatus of claim 38 wherein said control means includes means to convert said position signal into a rate signal, and wherein said resistance force is increased to a predetermined level above a predetermined rate of pedal member motion.

40. The apparatus of claim 39 including a display means operatively connected to said control means for displaying said rate of pedal member motion.

41. The apparatus of claim 40 wherein said display of rate of pedal motion is displayed in floors per minute.

42. The apparatus of claim 40 wherein said display means generates a display representing the range of said pedal member motion.

43. The apparatus of claim 42 additionally including user input means operatively connected to said control means for allowing a user to input a desired step range and wherein said display of the range of motion of said pedal members is displayed as a percentage of said desired step range.

44. The apparatus of claim 40 additionally including user input means operatively connected to said control means for allowing a user to input a desired effort level and wherein said display means generates a display of actual effort as a percent of said desired effort level.

45. The apparatus of claim 40 additionally including connection means for directly connecting said first pedal member to said second pedal member such that said pedal members are limited to rotational movement in opposite directions.

46. The apparatus of claim 45 additionally including force resistance means responsive to said position signal for opposing the rotational movement of said pedal members.

47. The apparatus of claim 46 wherein said resistance means includes an alternator connected to said pedal members and control means responsive to said position signal for applying a control current to said alternator which is functionally related to the rate of change of said position signal.

48. The apparatus of claim 45 additionally including cross-connected damping means for resiliently damping the upward motion of each of said pedal members as it approaches a predetermined upper limit of said rotational movement.

49. The apparatus of claim 48 wherein said cross-connected damping means includes a resilient member secured to each of said pedal members and a pair of stops secured to said frame configured to receive each of said resilient members as its respective pedal member approaches said predetermined upper limit.

50. The apparatus of claim 49 wherein said resilient members are helical compression springs.

51. The apparatus of claim 50 wherein said cross-connected damping means includes a pair of resilient members secured to said frame such that one of said resilient members compressibly contacts each of said pedal members as it approaches said predetermined upper limit.

52. The apparatus of claim 51 wherein said resilient members are helical compression springs.

53. The apparatus of claim 45 additionally including an alternator for generating a force to oppose the rotational movement of said pedal members and control means responsive to a rate signal from said alternator for increasing the force output of said alternator to a predetermined level when the rate of rotation of said alternator reaches a preselected rate.

54. A stair climbing exercise apparatus comprising:

a frame;

a first pedal member to support one foot of a standing user, said first pedal member being pivotally secured to said frame for limited rotational movement in a vertical direction;

a second pedal member to support the other foot of a standing user, said second pedal member being pivotally secured to said frame for limited rotational movement in a vertical direction;

detection means for detecting the actual range of said rotational movement of said pedal means; and display means operatively connected to said detection means for displaying an indication of the actual range of said rotational movement of said pedal members.

55. The apparatus of claim 54 additionally including user input means operatively connected to said display means for permitting a user to selectively input a desired range of said rotational movement into said display means.

56. The apparatus of claim 55 wherein said display means includes means for displaying said actual range in comparison to said desired range.

57. The apparatus of claim 54 wherein said display means includes means for measuring the repetition rate of said rotational motion and generating a display comparing said repetition, rate to a predetermined repetition rate.

58. The apparatus of claim 57 additionally including user input means operatively connected to said display means for permitting a user to selectively input said predetermined repetition rate to said display means.

59. A stair climbing exercise apparatus comprising:

a frame;

a first pedal member pivotally secured to said frame for limited rotational movement in a vertical direction;

a second pedal member pivotally secured to said frame for limited rotational movement in a vertical direction;

connection means for directly connecting said first pedal member to said second pedal member such that said pedal members are limited to said rotational movement in opposite directions;

force means for applying a resistance force to said pedal members that effectively limits said pedal rotational movement to a predetermined rate; and display means operatively connected to said pedal members for generating a display of actual user effort derived from the rate of said rotational movement of said pedal members.

60. The apparatus of claim 59 additionally including input means operatively connected to said display means for permitting a user to selectively input a desired user effort and wherein said display means additionally displays said desired user effort.

61. The apparatus of claim 59 wherein said user effort is displayed as a percentage of a predetermined user effort.

62. The apparatus of claim 61 additionally including input means operatively connected to said display means for permitting a user to selectively input said predetermined user effort into said display means.

63. The apparatus of claim 62 wherein said display means includes a linear array of LEDs wherein said display means includes means for sequentially lighting said LEDs in said linear array to indicate said percentage of said predetermined user effort.

64. The apparatus of claim 60 wherein said desired and said actual effort are displayed in floors per minute.

65. A stair climbing exercise apparatus comprising:

a frame;

a first pedal member to support one foot of a standing user, said first pedal member being pivotally secured to said frame for rotational movement in a vertical direction;

a second pedal member to support the other foot of a standing user, said second pedal member being pivotally secured to said frame for rotational movement in a vertical direction;

connection means for directly connecting said first pedal member to said second pedal member such that said pedal members are limited to said rotational movement in opposite directions; and force means for applying a resistance force to said pedal members that effectively limits said rotational movement to a predetermined rate.

66. The apparatus of claim 65 wherein said force means includes rate means for generating a signal representing the actual rate of said rotational movement and control means for comparing said actual rate signal to said predetermined rate and for generating said resistive force when said actual rate equals said predetermined rate.

67. The apparatus of claim 66 wherein said rate means is operatively connected to and is responsive to said connection means to generate said actual rate signal.

68. The apparatus of claim 67 wherein said rate means includes a position detector operatively connected to said connection means.

69. The apparatus of claim 66 additionally including input means for permitting a user to selectively input said predetermined rate into said control means.

70. The apparatus of claim 65 wherein said force means includes an alternator operatively connected to said connection means.

71. The apparatus of claim 66 wherein said force means includes an alternator operatively connected to said connection means and effective to apply said resistive force to said connection means.

72. The apparatus of claim 71 wherein said rate means is responsive to said connection means to generate said actual rate signal.

73. The apparatus of claim 72 wherein said rate means includes a position detector operatively connected to said connection means.

74. The apparatus of claim 65 wherein said force means includes an alternator operatively connected to said connection means and effective to apply said resistive force to said connection means and wherein said force means includes control means responsive to the rate of rotation of said alternator for generating said resistance force when said rate of rotation is equal to a predetermined rate.

75. A stair climbing exercise apparatus comprising:

a frame;

a first pedal member pivotally secured to said frame for rotational movement in a vertical direction;

a second pedal member pivotally secured to said frame for rotational movement in a vertical direction;

connection means for directly connecting said first pedal member to said second pedal member such that said pedal members are limited to said rotational movement in opposite directions and for connecting, including a drive chain cooperative connected between said first pedal member and said second pedal member; and chain tensioning means for absorbing slack in at least a portion of the length of said drive chain during said rotational movement of said first and second pedal members, said chain tensioning means including a sprocket mounted to said frame, said sprocket being biased towards, and engaging said drive chain.

76. The apparatus of claim 75 wherein said sprocket is mounted at one end of a lever arm, with said lever arm mounted for pivotal movement on said frame.

77. The apparatus of claim 76 wherein said sprocket is biased towards said drive chain by a compression spring between said frame and said lever arm.

78. A stair climbing exercise apparatus comprising:

a. a frame;

b. a first pedal member pivotally secured to said frame for rotational movement in a vertical direction;

c. a second pedal member pivotally secured to said frame for rotational movement in a vertical direction;

d. an alternator, having a shaft and a control field, secured to said frame;

e. connection means for directly connecting said first pedal member to said second pedal member such that said pedal members are limited to said rotational movement in opposite directions and for connecting said pedal members to said alternator such that said alternator is effective to apply a resistance force opposing said pedal member movement, said connection means including a drive chain operatively connected with said first pedal member and said second pedal member and a transmission means for connecting said drive chain to said alternator; and f. dispensing means secured to said frame for dispensing a lubricating fluid onto the said drive chain.

79. The apparatus of claim 78 wherein said dispensing means includes a first applicator and a second applicator, both said applicators administering lubricating fluid onto said drive chain, said first applicator being secured to a first side of the frame and the said second applicator being secured to a second side of the frame.

80. The apparatus of claim 79 wherein said dispensing means includes a pumping system in fluid communication with each said applicator and furnishing predetermined amounts of lubricating fluid at predetermined times to said applicators.

81. The apparatus of claim 80 wherein the pumping system comprises a reservoir and a pumping means in fluid communication with said reservoir, said pumping means receiving lubricating oil from said reservoir and transmitting said lubricating fluid to each said applicators.

82. The apparatus of claim 81 wherein the said pumping means comprises a first pump in fluid communication with said first applicator and a second pump in fluid communication with said second applicator, said first pump furnishing predetermined amounts of lubricating fluid at precalculated times to said first applicator and said second pump furnishing predetermined amounts of lubricating fluid at said precalculated times to said second applicator.

83. The apparatus of claim 82 wherein each said applicator includes a sleeve and a brush depending from said stem, each said sleeve being in fluid communication with said pumping means and having a continuous passage therethrough designed to permit the flow of lubricating fluid onto said brush, said brush providing a means to apply the lubricating fluid onto said drive chain.

84. The apparatus of claim 78 wherein said connecting means includes a first one way clutch operatively interposed between said drive chain and said transmission means effective to rotate said transmission means in a first direction when said first pedal member is moving downwardly and a second one way clutch operatively interposed between said drive chain and said transmission means effective to rotate said transmission means in said first direction when said second pedal member is moving downwardly.

85. The apparatus of claim 84 wherein said connecting means includes a first sprocket rotatably secured to said first pedal member and a second sprocket rotatably secured to said second pedal member, said drive chain being attached at each end to said frame and engaging therebetween first and second sprockets on said first and second pedal members.

86. The apparatus of claim 85 wherein said connection means includes a first shaft rotatably secured to said frame, said first and second one way clutches being secured to said first shaft.

87. The apparatus of claim 86 wherein said first and second sprockets engage and lead said drive chain to said first and second one way clutches, respectively.

88. The apparatus of claim 87 wherein said connection means includes a first and a second sprocket pulley rotationally secured to a lower portion of said frame for engaging and leading said drive chain from said first one way clutch under said pedal members to said second one way clutch.

89. The apparatus of claim 88 wherein said one way clutches include a first chain sprocket and a second chain sprocket engaged with said drive chain wherein the rotational plane of each said sprocket pulleys is oriented approximately 90 degrees to the rotational plane of each said chain sprocket.

90. The apparatus of claim 89 wherein said drive chain includes: a first portion having links engaged with said first sprocket and said first chain sprocket; a second portion attached to said first portion including links oriented at a 90 degree angle to said first portion links and engaged with each said sprockets pulleys; a third portion attached to said second portion including links oriented at a 90 degree angle to said second portion links and engaged with said second sprocket and said second chain sprocket.

91. The apparatus of claim 90 wherein said transmission means includes a first pulley secured to said first shaft, a second pulley attached to a second shaft which is rotatably attached to said frame, a first drive belt connecting said first pulley to said second shaft and a second drive belt connecting said second pulley to said alternator shaft.

92. The apparatus of claim 78 wherein said drive chain is attached at one end to said first pedal member and attached at the other end to said second pedal member.

93. The apparatus of claim 92 wherein said connection means includes a first one way clutch operatively interposed between said drive chain and said transmission means effective to rotate said transmission means in a first direction when said first pedal member is moving downwardly and a second one way clutch operatively interposed between said chain and said transmission means effective to rotate said transmission in said first direction when said second pedal member is moving downwardly.

94. The apparatus of claim 93 wherein said connection means includes a first shaft rotationally secured to said frame and secured to said first and second one way clutches and said transmission means.

95. The apparatus of claim 94 wherein said connection means includes a first and a second sprocket pulley rotationally secured to a lower portion of said frame for engaging and leading said drive chain from said first one way clutch under said pedal members to said second one way clutch.

96. The apparatus of claim 95 wherein said first one way clutch includes a first chain sprocket engaged with said drive chain and said second one-way clutch includes a second chain sprocket also engaged with said drive chain wherein the rotational plane of said sprocket pulleys are orientated approximately 90 degrees to the rotational plane of said chain sprockets.

97. The apparatus of claim 96 wherein said drive chain includes a first portion attached to said first pedal member and having links engaged with said first chain sprocket; a second portion attached to said first portion including links orientated at a 90 degree angle to said first portion links and engaged with said sprocket pulleys; and a third portion attached to said second portion and said second pedal member including links orientated a 90 degree angle to said second portion links and engaged with said second chain sprocket.

98. The apparatus of claim 97 wherein said transmission means includes a first pulley secured to said first shaft, a second pulley attached to a second shaft which is rotatably attached to said frame, a first drive belt connecting said first pulley to said second shaft and a second drive belt connecting said second pulley to said alternator shaft.

99. The apparatus of claim 78 further including control means operatively connected to said alternator for applying a control current to said alternator control field in response to the rate of rotational movement of said alternator, the control means also operatively connected to said dispensing means for activating the dispensing means at precalculated times in order to apply a predetermined amount of lubricating fluid onto said driving chain.

100. The apparatus of claim 99 further including detection means operatively connected to said control means and includes rate means for generating a rate signal representing the rate of rotational motion of said pedal members.

101. The apparatus of claim 100 wherein said control means responds to said rate signal to increase said field current to a predetermined level when said rate of rotational motion reaches a preselected rate.

102. The apparatus of claim 101 additionally including display means operatively connected to said control means for displaying a step range indication in response to said position signal.

103. The apparatus of claim 102 additionally including a position sensor operatively connected to said first sprocket pulley and said control means for generating a position signal representing the rotational position of said pedal members.

104. The apparatus of claim 103 wherein said control means includes means for generating said alternator field current as a function of the rate of change of said position signal.

105. The apparatus of claim 104 additionally including means operatively connected to said alternator for generating a rate signal, said rate signal representing the rate of rotation of said pedal members.

106. The apparatus of claim 105 wherein said rate signal means is operatively connected to said control means.

107. The apparatus of claim 106 wherein said control means responds to said rate signal to increase said field current to a predetermined level when said rate of rotation reaches a preselected level.

108. The apparatus of claim 107 additionally including display means operatively connected to said control means for generating a display representing the range of pivotal motion of said pedal members, said display means including user input means operatively connected to said control means for allowing the user to input a desired effort level.

109. The apparatus of claim 107 wherein said control means responds to a function of said rate signal for generating said field current.

110. The apparatus of claim 106 wherein said control means responds to a function of said rate signal to activate said dispensing means.

111. The apparatus of claim 110 wherein said control means responds to a function of the rate change of said rate signal to activate said dispensing means when said function reaches a preselected level.

112. The apparatus of claim 78 additionally including cross-connected damping means for resiliently damping the upward motion of each of said pedal members as each said pedal member approaches a predetermined upper limit of said rotational movement.

113. The apparatus of claim 112 wherein said cross-connected damping means includes a pair of resilient members secured to said frame such that one of said resilient members compressibly contacts each of said pedal members as it approaches said predetermined upper limit.

114. The apparatus of claim 113 wherein at least one of said resilient members are composed of a material selected from the group consisting of polyphenylene oxide, polystyrene, polycarbonate, polyurethane, polyester, or mixtures thereof.

115. The apparatus of claim 114 wherein at least one of said resilient support members has a generally donut shape.

116. The apparatus of claim 115 wherein said resilient support members have a height in the range of approximately 1 to ½ inches.

117. The apparatus of claim 116 wherein at least one of said resilient members is an elastomeric spring damper.

118. The apparatus of claim 112 wherein said cross-connected damping means includes a resilient member secured to each of said pedal members and a pair of stops secured to said frame configured to receive each of said resilient members as its respective pedal member approaches said predetermined upper limit.

119. The apparatus of claim 118 wherein said resilient members are helical compression springs.

120. The apparatus of claim 119 wherein said cross-connected damping means include a pair of resilient members secured to said frame such that one of said resilient members compressibly contacts each of said pedal members as it approaches said predetermined upper limit.

121. The apparatus of claim 120 wherein said resilient members are helical compression springs.

122. The apparatus of claim 120 wherein at least one of said resilient members are composed of a material selected from the group consisting of polyphenylene oxide, polystyrene, polycarbonate, polyurethane, polyester, or mixtures thereof.

123. The apparatus of claim 122 wherein at least one of said resilient support members has a generally donut shape.

124. The apparatus of claim 122 wherein said resilient support members have a height in the range of approximately 1 to 1½ inches.

125. The apparatus of claim 122 additionally including cross-connected damping means for resiliently damping the downward motion of each of said pedal members as it approaches a predetermined lower limit of said rotational movement.

126. The apparatus of claim 78 additionally including first cross-connected damping means for resiliently damping the upward motion of each said pedal member as each said pedal member approaches a predetermined upper limit of said rotational movement, and additionally including second cross-connected damping means for resiliently damping the downward motion of each said pedal member as each said pedal member approaches a predetermined lower limit of said rotational movement.

127. The apparatus of claim 126 wherein at least one of said cross-connected damping means including a pair of resilient members secured to said frame such that each said resilient members compressibly contacts a different approaching pedal member.

128. The apparatus of claim 127 wherein both of said cross-connected damping means include a pair of resilient members secured to said frame such that one of said resilient members of said first damping means compressibly contacts a pedal member as it approaches a predetermined upper limit and one of said resilient members of second damping means compressibly contacts a pedal member as it approaches a predetermined lower limit of said rotational movement.

129. The apparatus of claim 128 wherein at least one of said resilient members are composed of a material selected from the group consisting of polyphenylene oxide, polystyrene, polycarbonate, polyurethane, polyester, or mixtures thereof.

130. The apparatus of claim 129 wherein at least one of said resilient support members has a generally donut shape.

131. The apparatus of claim 130 wherein said resilient support members have a height in the range of approximately 1 to 1½ inches.

132. A stair climbing exercise apparatus comprising:

a. a frame;

b. a first pedal member pivotally secured to said frame for rotational movement in a vertical direction;

c. a second pedal member pivotally secured to said frame for rotational movement in a vertical direction;

d. an alternator, having a shaft and a control field, secured to said frame;

e. connection means for directly connecting said first pedal member to said second pedal member such that said pedal members are limited to said rotational movement in opposite directions including a chain drive operatively connected with said first pedal member and said second pedal member, and including transmission means for connecting said drive chain to said alternator shaft, said connection means includes a first shaft rotationally secured to said frame and a first one way clutch operatively interposed between said drive chain and said transmission means effective to rotate said transmission means in a first direction when said first pedal member is moving downwardly and to a second one way clutch operatively interposed between said drive chain and said transmission means effective to rotate said transmission in said first direction when said second pedal member is moving downwardly, and said transmission means includes a first pulley secured to said first shaft and a drive belt connecting said first pulley to said alternator shaft;

f. dispensing means secured to said frame for dispensing a lubricating fluid onto said drive chain; and g. control means operatively connected to said alternator for applying a control current to said alternator control field in response to the rate of rotational movement of said alternator, the said control means also operatively connected to said dispensing means for activating the said dispensing means.

133. The apparatus of claim 132 wherein said drive chain is attached at each end to said frame, and engages therebetween first and second sprockets on said first and second pedal members, respectively.

134. The apparatus of claim 133 wherein said first and second sprockets engage and lead said drive chain to said first and second one way clutches, respectively.

135. A stair climbing exercise apparatus comprising:
a. a frame;
b. a first pedal member to support one foot of a standing user, said first pedal member being pivotally connected to said frame for rotational movement in a vertical direction;
c. a second pedal member to support the other foot of the standing user, said first pedal member being pivotally connected to said frame for rotational movement in a vertical direction;
d. a connection means for directly connecting said first pedal member to said second pedal member such that said pedal members are limited to said rotational mount in opposite directions; and
e. a dispensing means to dispense lubricating fluid onto said connecting means.

136. The apparatus of claim 135 additionally including resistance means operatively connected to said pedal members for generating a resistance force for opposing the rotational motion of said pedal members.

137. The apparatus of claim 136 additionally including a control means operatively connected to said resistance means and said dispensing means, the control means controlling said resistance means and said dispensing means.

138. The apparatus of claim 137 wherein said resistance force is increased by said control means to a predetermined level in response to a rate signal generated by a detection means when said rate of rotation of said pedal members reaches a preselected level.

139. The apparatus of claim 138 including a display means operatively connected to said control means for displaying said rate of pedal motion.

140. The apparatus of claim 139 wherein said display rate is displayed in floors per minute.

141. The apparatus of claim 140 wherein said display means generates a display representing the range of said pedal motion.

142. The apparatus of claim 135 additionally including user input means operatively connected to said control means for allowing a user to input a desired step range and wherein said display of the range of motion of said pedal members is displayed as a percentage of said desired step range.

143. The apparatus of claim 142 wherein said display means includes a linear array of LEDS wherein said display means includes means for sequentially lighting said LEDS to indicate said percentage of said desired step range.

144. The apparatus of claim 135 additionally including user input means operatively connected to said control means for allowing a user to input a desired effort level and wherein said display means generates a display of actual effort as a percent of said desired effort level.

145. The apparatus of claim 144 wherein said display means includes a linear array of LEDS wherein said display means includes means for sequentially lighting said LEDS to indicate said percentage of said desired effort level.

146. The apparatus of claim 137 wherein said resistance means includes an alternator connected to said pedal member and control means responsive to a function of said rate signal for applying a control current to said alternator.

147. The apparatus of claim 146 wherein said connection means includes a drive chain.

148. The apparatus of claim 147 additionally including cross-connected damping means for resiliently damping the upward motion of each said pedal member as it approaches a predetermined upper limit of said rotational movement.

149. The apparatus of claim 135 wherein said dispensing means dispenses lubricating fluid on said connection means at precalculated times and in predetermined amounts.

150. The apparatus of claim 149 wherein the connection means includes a drive chain operatively connected with said first pedal member and said second pedal member.

151. The apparatus of claim 150 wherein said control means is responsive to a function of a rate signal thereby activating said lubricating means at said precalculated times to dispense lubricating fluid onto said drive chain.

152. The apparatus of claim 151 wherein said dispensing means includes a first applicator and a second applicator, each said applicators administering lubricating fluid on said drive chain, said first applicator being secured to a first side of the frame and said second applicator being secured to a second side of the frame.

153. The apparatus of claim 152 wherein said dispensing means includes a pumping system in fluid communication with said applicators and furnishing predetermined amounts of lubricating fluid at said precalculated times to the said applicators.

154. The apparatus of claim 153 wherein the pumping system comprises a reservoir and a pumping means in fluid communication with said reservoir, said pumping means receiving lubricating oil from the said reservoir and transmitting said lubricating fluid to each said applicators.

155. The apparatus of claim 154 wherein the said pumping means comprises a first pump in fluid communication with said first applicator and a second pump in fluid communication with said second applicator, said first pump furnishing predetermined amounts of lubricating fluid at said precalculated times to said first applicator and said second pump furnishing predetermined amounts of lubricating fluid at said precalculated times to said second applicator.

156. The apparatus of claim 152 wherein each said applicator includes a stem and a brush depending from said stem, each said stem being in fluid communication with said pumping means and having a continuous passage therethrough designed to permit the flow of lubricating fluid onto said brush, said brush providing a means to apply the lubricating fluid onto said drive chain.

157. A stair climbing exercise apparatus comprising:
a. a frame;
b. a first pedal member to support one foot of a standing user, said first pedal member being pivotally connected to said frame for rotational movement in a vertical direction;
c. a second pedal member to support the other foot of the standing user, said first pedal member being pivotally connected to said frame for rotational movement in a vertical direction;
d. connection means for directly connecting said first pedal member to said second pedal member such that said pedal members are limited to said rotational movement in opposite directions;
e. dispensing means for dispensing a lubricating fluid onto said connection means; and f. force means for applying a resistance force to said pedal members effectively limiting said rotational movement to a predetermined rate.

158. The apparatus of claim 157 wherein said force means includes a rate means for generating a signal representing the actual rate of rotational movement of said pedal members and a control means for comparing said actual rate signal to said predetermined rate in order to generate said resistive force when said actual rate equals said predetermined rate, said control means also activating said dispensing means in response to a function of the said rate signal.

159. The apparatus of claim 158 wherein said rate means is operatively connected to and is responsive to said connection means to generate said actual rate signal.

160. The apparatus of claim 159 wherein the said rate means includes a detection means for sensing the rate of rotational movement of said pedal member.

161. The apparatus of claim 160 additionally including input means for permitting a user to selectively input said predetermined rate into said control means.

162. The apparatus of claim 161 wherein said force means includes an alternator operatively connected to said connection means.

163. The apparatus of claim 159 wherein said force means includes an alternator operatively connected to said connection means and effective to apply said resistive force to said connection means.

164. The apparatus of claim 163 wherein said rate means is responsive to said connection means to generate said rate signal.

165. The apparatus of claim 164 wherein said rate means includes a detection means operatively connected to said connection means.

166. The apparatus of claim 157 wherein the connection means includes a driving chain operatively connected with said first pedal member and said second pedal member.

167. The apparatus of claim 166 wherein said dispensing means includes a first applicator and a second applicator, both said applicators administering lubricating fluid on said drive chain, said first applicator being secured to a first side of the frame and said second applicator being secured to a second side of the frame.

168. The apparatus of claim 167 wherein said dispensing means includes a pumping system in fluid communication with said applicators, said pumping system furnishing predetermined amounts of lubricating fluid at precalculated times to the said applicators.

169. The apparatus of claim 168 wherein said pumping system comprises a reservoir and a pumping means in fluid communication with said reservoir, said pumping means receiving lubricating oil from said reservoir and transmitting said lubricating fluid to each said applicators.

170. The apparatus of claim 169 wherein the said pumping means comprises a first injector pump in fluid communication with said first applicator and a second injector pump in fluid communication with said second applicator, said first injector pump furnishing predetermined amounts of lubricating fluid at said predetermined times to the said first applicator and the second injector pump furnishing predetermined amounts of lubricating fluid at said predetermined times to the said second applicator.

171. The apparatus of claim 170 wherein each said applicator includes a stem and a brush depending from said stem, each said stem being in fluid communication with said pumping means and having a continuous passage therethrough designed to permit the flow of lubricating fluid onto said brush, said brush providing a means to apply the lubricating fluid onto said drive chain.

172. A stair climbing exercise apparatus comprising:

a. a frame;

b. a first pedal member pivotally secured to said frame for rotational movement in a vertical direction;

c. a second pedal member pivotally secured to said frame for rotational movement in a vertical direction;

d. connection means for directly connecting said first pedal member to said second pedal member such that said pedal members are limited to said rotational movement in opposite directions including a chain drive operatively connected with said first pedal member and said second pedal member;

e. dispensing means secured to said frame for dispensing lubricating fluid onto said connection means; and f. display means operatively connected to said pedal members for generating a display of actual user effort derived from the rate of said rotational movement of said pedal members.

173. The apparatus of claim 172 additionally including a force means for applying resistance to said pedal members that effectively limits said rotational movement to a predetermined rate.

174. The apparatus of claim 173 additionally including a control means operatively connected to said resistance means and said dispensing means, the control means governing said resistance means and said lubricating means.

175. The apparatus of claim 174 additionally including a detection means operatively connected with said control means for detecting the actual rate of movement of said pedal members, said detection means generating a rate signal wherein said control means is responsive to said rate signal.

176. The apparatus of claim 175 wherein the connection means includes a driving chain operatively connected with said first pedal member and said second pedal member.

177. The apparatus of claim 176 wherein the dispensing means comprises a first applicator mounted on one side of said frame and a second applicator mounted on a second side of said frame, each said applicator includes a stem and a brush depending from said stem, said brush providing a means to apply the lubricating fluid onto said drive chain.

178. The apparatus of claim 177 wherein said dispensing means includes a pumping system, in fluid communication with said applicators, furnishing predetermined amounts of lubricating fluid at predetermined times to the said applicators.

179. The apparatus of claim 178 wherein the pumping system comprises a reservoir and a pumping means in fluid communication with said reservoir, said pumping means receiving lubricating oil from said reservoir and transmitting said lubricating fluid to each said applicators.

180. The apparatus of claim 179 wherein the said pumping means comprises a first pump in fluid communication with said first applicator and a second pump in fluid communication with said second applicator, said first pump furnishing predetermined amounts of lubricating fluid at said precalculated times to said first applicator and said second pump furnishing predetermined amounts of lubricating fluid at said precalculated times to said second applicator.

* * * * *

UNITED STATES PATENT AND TRADEMARK OFFICE

CERTIFICATE OF CORRECTION

PATENT NO. : 5,135,447

DATED : August 4, 1992

INVENTOR(S) : Robards, Jr. et al.

It is certified that error appears in the above-identified patent and that said Letters Patent is hereby corrected as shown below:

Column 1, line 29, delete "he" and insert --the--

Column 2, line 24, after "exercise" insert a period (.)

Column 6, line 3, delete "Work" and insert --work--

Column 6, line 25, change "sen or" to --sensor--

Column 9, line 16, delete "too" and insert --two--

Column 10, lines 45-46, after "sections" insert a period (.)

Column 10, line 50, after "have" insert "a"

Column 19, line 62, after "repetition" delete the comma ","

On the title page, at item [63], delete "Oct. 29," and insert therefor --Oct. 24,--

Column 1, line 8, delete "Oct. 29," and insert therefor --Oct. 24,--

UNITED STATES PATENT AND TRADEMARK OFFICE

CERTIFICATE OF CORRECTION

PATENT NO. : 5,135,447

DATED : August 4, 1992

INVENTOR(S) : Robards, Jr. et al.

It is certified that error appears in the above-identified patent and that said Letters Patent is hereby corrected as shown below:

Col. 9, line 47, after "FIG." delete the comma ","

Signed and Sealed this

Ninth Day of November, 1993

*Attest:*

*Attesting Officer*

BRUCE LEHMAN

*Commissioner of Patents and Trademarks*